US011535449B2

(12) United States Patent
Yang et al.

(10) Patent No.: US 11,535,449 B2
(45) Date of Patent: Dec. 27, 2022

(54) TRASH CAN ASSEMBLY

(71) Applicant: simplehuman, LLC, Torrance, CA (US)

(72) Inventors: Frank Yang, Rancho Palos Verdes, CA (US); Di-Fong Chang, Torrance, CA (US); Zachary Rapoport, Northridge, CA (US); William Patrick Conley, Long Beach, CA (US)

(73) Assignee: simplehuman, LLC, Torrance, CA (US)

( * ) Notice: Subject to any disclaimer, the term of this patent is extended or adjusted under 35 U.S.C. 154(b) by 204 days.

(21) Appl. No.: 16/293,463

(22) Filed: Mar. 5, 2019

(65) Prior Publication Data

US 2019/0276232 A1 Sep. 12, 2019

Related U.S. Application Data

(60) Provisional application No. 62/639,900, filed on Mar. 7, 2018.

(51) Int. Cl.
*B65F 1/16* (2006.01)
*B65F 1/14* (2006.01)

(52) U.S. Cl.
CPC ..... *B65F 1/163* (2013.01); *B65F 1/1421* (2013.01); *B65F 2001/1653* (2013.01)

(58) Field of Classification Search
CPC ..... B65F 1/163; B65F 1/1421; B65F 1/06; B65F 1/16; B65F 1/1623; B65F 1/04; B65F 1/08; B65F 2001/1653; B65D 43/262

(Continued)

(56) References Cited

U.S. PATENT DOCUMENTS 830,182 A 9/1906 Skov
1,426,211 A 8/1922 Pausin
(Continued)

FOREIGN PATENT DOCUMENTS

AU 622536 4/1992
CA 2182840 9/1997
(Continued)

OTHER PUBLICATIONS

U.S. Appl. No. 29/484,903, filed Mar. 13, 2014, Yang et al.
(Continued)

*Primary Examiner* — Don M Anderson
*Assistant Examiner* — Elizabeth J Volz
(74) *Attorney, Agent, or Firm* — Knobbe, Martens, Olson & Bear, LLP

(57) ABSTRACT

Various trash can assembly embodiments are disclosed. The trash can assembly can include a body, a lid, an actuation system, and an active dislodgement or return system. The active dislodgement or return system can be configured to facilitate dislodging the trash can assembly from a surrounding environment, such as a wall. The active dislodgement or return system can include a dynamic member having a frame, a foot movably coupled to the frame, and a spring applying a force on the foot. When an actuation force is removed from the actuation system, the dynamic member can apply a force against the surrounding environment, such as a floor, to move the body relative to the surrounding environment.

20 Claims, 13 Drawing Sheets

(58) Field of Classification Search
USPC ..... 220/263, 908, 23.87, 495.08, 495.01, 220/495.06
See application file for complete search history.

(56) References Cited

U.S. PATENT DOCUMENTS 1,461,253 A 7/1923 Owen
1,754,802 A 4/1930 Raster
1,820,555 A 8/1931 Man
1,891,651 A 12/1932 Padelford et al.
1,922,729 A 8/1933 Geibel
1,980,938 A 11/1934 Geibel
2,046,777 A 7/1936 Geibel
2,308,326 A 1/1943 Calcagno
D148,825 S 2/1948 Snider
2,457,274 A 12/1948 Rifken
2,593,455 A * 4/1952 James ..... A61B 50/37 422/184.1
2,759,625 A 8/1956 Ritter
2,796,309 A 6/1957 Taylor
2,888,307 A 5/1959 Graves et al.
2,946,474 A 7/1960 Knapp
3,008,604 A 11/1961 Garner
3,023,922 A 3/1962 Arrington et al.
3,137,408 A 6/1964 Taylor
3,300,082 A 1/1967 Patterson
3,392,825 A 7/1968 Gale et al.
3,451,453 A 6/1969 Heck
3,654,534 A 4/1972 Fischer
3,800,503 A 4/1974 Maki
3,820,200 A 6/1974 Myers
3,825,150 A 7/1974 Taylor
3,825,215 A 7/1974 Borglum
3,886,425 A 5/1975 Weiss
3,888,406 A 6/1975 Nippes
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,349,123 A 9/1982 Yang
4,357,740 A 11/1982 Brown
4,416,197 A 11/1983 Kehl
4,417,669 A 11/1983 Knowles et al.
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A 3/1988 Ziegenbein
4,753,367 A 6/1988 Miller et al.
4,763,808 A 8/1988 Guhl et al.
4,765,548 A 8/1988 Sing
4,765,579 A 8/1988 Robbins, III et al.
4,785,964 A 11/1988 Miller et al.
4,792,039 A 12/1988 Dayton
4,794,973 A 1/1989 Perisic
4,813,592 A 3/1989 Stolzman
4,823,979 A 4/1989 Clark, Jr.
4,834,260 A 5/1989 Auten
4,863,053 A 9/1989 Oberg
4,867,339 A 9/1989 Hahn
4,869,391 A 9/1989 Farrington
4,884,717 A 12/1989 Bussard et al.
4,888,532 A 12/1989 Josson
4,892,223 A 1/1990 DeMent
4,892,224 A 1/1990 Graham
D307,344 S 4/1990 Massonnet
4,913,308 A 4/1990 Culbertson
4,915,347 A 4/1990 Iqbal et al.
4,918,568 A 4/1990 Stone et al.
D308,272 S 5/1990 Koepsell
4,923,087 A 5/1990 Burrows
4,944,419 A 7/1990 Chandler
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
D322,350 S 12/1991 Craft, Jr. et al.
5,076,462 A 12/1991 Perrone
D323,573 S 1/1992 Schneider
5,090,585 A 2/1992 Power
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Samson et al.
5,156,290 A 10/1992 Rodrigues
D331,097 S 11/1992 Sieren
5,170,904 A 12/1992 Neuhaus
5,174,462 A 12/1992 Hames
D332,852 S 1/1993 Delmerico
D335,562 S 5/1993 Evans
5,213,272 A 5/1993 Gallagher et al.
5,222,704 A 6/1993 Light
D337,181 S 7/1993 Warman
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,265,511 A 11/1993 Itzov
5,295,607 A 3/1994 Chang
5,305,916 A 4/1994 Suzuki et al.
5,314,151 A 5/1994 Carter-Mann
5,322,179 A 6/1994 Ting
5,329,212 A 7/1994 Feigleson
5,337,581 A 8/1994 Lott
5,348,222 A 9/1994 Patey
5,353,950 A 10/1994 Taylor et al.
5,372,272 A 12/1994 Jennings
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.
5,419,452 A 5/1995 Mueller et al.
5,471,708 A 12/1995 Lynch
5,474,201 A 12/1995 Liu
5,501,358 A 3/1996 Hobday
D368,563 S 4/1996 Brightbill et al.
5,520,067 A 5/1996 Gaba
5,520,303 A 5/1996 Bernstein et al.
5,527,840 A 6/1996 Chutko et al.
5,531,348 A 7/1996 Baker et al.
5,535,913 A 7/1996 Asbach et al.
5,558,254 A 9/1996 Anderson et al.
5,560,283 A 10/1996 Hannig
5,584,412 A 12/1996 Wang
D377,554 S 1/1997 Adriaansen
5,611,507 A 3/1997 Smith
5,628,424 A 5/1997 Gola
5,632,401 A 5/1997 Hurd
5,636,416 A 6/1997 Anderson
5,636,761 A 6/1997 Diamond et al.
5,644,111 A 7/1997 Cerny et al.
5,645,186 A 7/1997 Powers et al.

(56) References Cited

U.S. PATENT DOCUMENTS 5,650,680 A 7/1997 Chula
D383,277 S 9/1997 Peters
5,662,235 A 9/1997 Nieto
5,671,847 A 9/1997 Pedersen et al.
5,690,247 A 11/1997 Boover
5,695,088 A 12/1997 Kasbohm
5,699,929 A 12/1997 Ouno
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia
5,770,935 A 6/1998 Smith et al.
5,799,909 A 9/1998 Ziegler
5,816,431 A 10/1998 Giannopoulos
5,816,640 A 10/1998 Nishimura
D401,028 S 11/1998 Ahern, Jr. et al.
D401,383 S 11/1998 Gish
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
D412,552 S 8/1999 Burrows
5,961,105 A 10/1999 Ehrnsberger et al.
5,967,355 A 10/1999 Ragot
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien
6,105,859 A 8/2000 Stafford
6,123,215 A 9/2000 Windle
D431,700 S 10/2000 Roudebush
6,126,031 A 10/2000 Reason
6,129,233 A 10/2000 Schiller
6,131,861 A 10/2000 Fortier, Jr. et al.
D435,951 S 1/2001 Yang et al.
6,209,744 B1 4/2001 Gill
6,211,637 B1 4/2001 Studer
6,234,339 B1 5/2001 Thomas
6,250,492 B1 6/2001 Verbeek
D445,980 S 7/2001 Tjugum
6,286,706 B1 9/2001 Tucker
6,328,320 B1 12/2001 Walski et al.
6,345,725 B1 2/2002 Lin
6,364,147 B1 4/2002 Meinzinger et al.
6,386,386 B1 5/2002 George
6,390,321 B1 5/2002 Wang
6,401,958 B1 6/2002 Foss et al.
D466,667 S 12/2002 Lin
6,519,130 B1 2/2003 Breslow
6,557,716 B1 5/2003 Chan
D476,456 S 6/2003 Englert et al.
D476,457 S 6/2003 Verbeek
6,596,983 B2 7/2003 Brent
D480,193 S 9/2003 Wang
6,612,099 B2 9/2003 Stravitz
6,626,316 B2 9/2003 Yang
6,626,317 B2 9/2003 Pfiefer et al.
D481,508 S 10/2003 Wang
6,632,064 B1 10/2003 Walker et al.
D481,846 S 11/2003 Lin
D482,169 S 11/2003 Lin
6,659,407 B2 12/2003 Asaro
6,681,950 B2 1/2004 Miller, Jr. et al.
6,701,832 B1 3/2004 Hawkins
D488,604 S 4/2004 Yang et al.
D488,903 S 4/2004 Yang et al.
D489,503 S 5/2004 Lin
D489,855 S 5/2004 Tseng
D489,857 S 5/2004 Yang et al.
D490,583 S 5/2004 Yang et al.
D490,954 S 6/2004 Brand
D491,706 S 6/2004 Yang et al.
6,758,366 B2 7/2004 Bourgund et al.
D493,930 S 8/2004 Wang
D494,723 S 8/2004 Lin
6,774,586 B1 8/2004 Shih
6,785,912 B1 9/2004 Julio
6,812,655 B1 11/2004 Wang et al.
6,814,249 B2 11/2004 Lin
D499,450 S 12/2004 Goodman et al.
6,837,393 B1 1/2005 Kuo
6,857,538 B2 2/2005 Lin
6,859,005 B2 2/2005 Boliver
D503,021 S 3/2005 Yang et al.
D503,022 S 3/2005 Lai
D503,502 S 3/2005 Lai
6,866,826 B2 3/2005 Moore et al.
6,883,676 B2 4/2005 Lin
D507,090 S 7/2005 Yang et al.
6,920,994 B2 7/2005 Lin
D509,339 S 9/2005 Lin
6,974,948 B1 12/2005 Brent
D513,445 S 1/2006 Lin
6,981,606 B2 1/2006 Yang et al.
D517,764 S 3/2006 Wang
D517,767 S 3/2006 Yang et al.
D518,266 S 3/2006 Yang et al.
7,017,773 B2 3/2006 Gruber et al.
D522,203 S 5/2006 Lin
D522,204 S 5/2006 Lin
7,044,323 B2 5/2006 Yang et al.
D522,704 S 6/2006 Lin
D524,504 S 7/2006 Lin
D525,756 S 7/2006 Yang et al.
7,073,677 B2 7/2006 Richardson et al.
7,077,283 B2 7/2006 Yang et al.
7,080,750 B2 7/2006 Wein et al.
D526,457 S 8/2006 Lin
D526,458 S 8/2006 Lin
D526,756 S 8/2006 Lin
7,086,550 B2 8/2006 Yang et al.
D528,726 S 9/2006 Lin
D530,476 S 10/2006 Lin
D530,874 S 10/2006 Lin
7,121,421 B2 10/2006 Yang et al.
D531,499 S 11/2006 Zaidman
D535,450 S 1/2007 Chen
D535,799 S 1/2007 Epps
D535,800 S 1/2007 Yang et al.
7,163,591 B2 1/2007 Kim et al.
7,168,591 B1 1/2007 Miller
D537,223 S 2/2007 Lin
D537,597 S 2/2007 Bolden
D537,599 S 2/2007 Lin
D537,601 S 2/2007 Lin
D537,999 S 3/2007 Lin
D538,995 S 3/2007 Lin
D539,498 S 3/2007 Yang et al.
D539,499 S 3/2007 Yang et al.
D540,001 S 4/2007 Zimmerman
D542,001 S 5/2007 Yang et al.
D542,995 S 5/2007 Lin
D543,673 S 5/2007 Yang et al.
D544,170 S 6/2007 Lin
D544,171 S 6/2007 Lin
D544,671 S 6/2007 Saunders et al.
D545,024 S 6/2007 Liao
7,225,943 B2 6/2007 Yang et al.
D547,020 S 7/2007 Chen
7,243,811 B1 7/2007 Ramsey
D550,918 S 9/2007 Wang et al.
D552,319 S 10/2007 Gusdorf
D552,321 S 10/2007 Yang et al.
D552,823 S 10/2007 Yang et al.
D552,824 S 10/2007 Zimmerman

(56) References Cited

U.S. PATENT DOCUMENTS

D552,825 S 10/2007 Yang et al.
D555,320 S 11/2007 Yang et al.
D557,869 S 12/2007 Hawker et al.
D559,494 S 1/2008 Yang et al.
D559,495 S 1/2008 Yang et al.
D562,522 S 2/2008 Daams
7,328,842 B2 2/2008 Wagner et al.
D564,169 S 3/2008 Wang
D564,723 S 3/2008 Yang et al.
D566,367 S 4/2008 Lin
D566,369 S 4/2008 Shek
D566,923 S 4/2008 Lin
D567,468 S 4/2008 Yang et al.
D568,572 S 5/2008 Yang et al.
D569,720 S 5/2008 Lablaine
7,374,060 B2 5/2008 Yang et al.
D571,520 S 6/2008 Lin
D574,119 S 7/2008 Sofy
7,395,990 B1 7/2008 Stevens
7,398,913 B2 7/2008 McClure
7,404,499 B1 7/2008 Ramsey
D574,569 S 8/2008 Yang et al.
D576,371 S 9/2008 Zimmerman
D578,265 S 10/2008 Presnell
D578,266 S 10/2008 Yang et al.
D578,268 S 10/2008 Yang et al.
D578,722 S 10/2008 Yang et al.
7,438,199 B1 10/2008 Tidrick
D580,120 S 11/2008 Lin
D580,613 S 11/2008 Yang et al.
D580,615 S 11/2008 Yang et al.
D581,622 S 11/2008 Presnell et al.
D582,121 S 12/2008 Wang et al.
D584,470 S 1/2009 Bizzell et al.
D585,171 S 1/2009 Bizzell et al.
D585,172 S 1/2009 Lin
D585,618 S 1/2009 Yang et al.
D586,065 S 2/2009 Lin
D586,066 S 2/2009 Lin
D586,069 S 2/2009 Lin
D586,070 S 2/2009 Lin
7,494,021 B2 2/2009 Yang et al.
D587,874 S 3/2009 Lin
D588,321 S 3/2009 Schoofs
D589,670 S 3/2009 Smeets
D593,271 S 5/2009 Yang et al.
7,530,578 B2 5/2009 Niemeyer et al.
7,540,396 B2 6/2009 Yang et al.
7,543,716 B2 6/2009 Lin
D596,820 S 7/2009 Yang et al.
7,559,433 B2 7/2009 Yang et al.
D599,074 S 8/2009 Bizzell et al.
D599,971 S 9/2009 Lin
D603,119 S 10/2009 Yang et al.
7,607,552 B2 10/2009 Efstathiou
D604,472 S 11/2009 Blanks et al.
7,614,519 B2 11/2009 Krauth et al.
7,621,420 B2 11/2009 Bandoh et al.
D608,069 S 1/2010 Schoofs
7,656,109 B2 2/2010 Yang et al.
D611,216 S 3/2010 Yang et al.
D611,217 S 3/2010 Bizzell et al.
D611,671 S 3/2010 Yang et al.
7,694,838 B2 4/2010 Yang et al.
7,703,622 B1 4/2010 Bynoe
D615,270 S 5/2010 Yang et al.
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 8/2010 Yang et al.
D623,817 S 9/2010 Yang et al.
D625,068 S 10/2010 Shannon
7,806,285 B2 10/2010 Yang et al.
D627,533 S 11/2010 Yang et al.
D627,944 S 11/2010 Wang et al.
D629,172 S 12/2010 Liao
D629,579 S 12/2010 Lin
D630,404 S 1/2011 Yang et al.
D631,221 S 1/2011 Yang et al.
D632,039 S 2/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D639,520 S 6/2011 Lin
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,096,445 B2 1/2012 Yang et al.
D655,061 S 2/2012 Scaturro
8,136,688 B2 3/2012 Lee et al.
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,393,489 B1 3/2013 Stravitz
8,418,869 B2 4/2013 Yang et al.
D684,741 S 6/2013 Harris
D689,255 S 9/2013 Sun Ting Kung et al.
8,567,630 B2 10/2013 Yang et al.
8,569,980 B2 10/2013 Yang et al.
8,575,537 B2 11/2013 Yao et al.
8,607,932 B2 * 12/2013 Cooper ..... E06C 7/423 182/172
8,672,171 B2 3/2014 Wynn et al.
8,678,219 B1 3/2014 Wang et al.
8,686,676 B2 4/2014 Yang et al.
D704,406 S 5/2014 Kern
8,716,969 B2 5/2014 Yang et al.
8,720,728 B2 5/2014 Yang et al.
D709,662 S 7/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D715,575 S 10/2014 Williams et al.
D716,015 S 10/2014 van de Leest
8,851,316 B2 10/2014 Barrett et al.
8,872,459 B2 10/2014 Yang et al.
D717,012 S 11/2014 Han
D717,013 S 11/2014 Han
D717,014 S 11/2014 Han
D717,015 S 11/2014 Han
D719,313 S 12/2014 Kao
D725,860 S 3/2015 Spivey et al.
D725,861 S 3/2015 Yang et al.
D730,008 S 5/2015 Yang et al.
9,051,093 B2 6/2015 Yang et al.
D755,461 S 5/2016 Wall
D758,686 S 6/2016 Beumer
D759,934 S 6/2016 Yang et al.
D762,037 S 7/2016 Chen
D765,937 S 9/2016 Chen
D766,998 S 9/2016 Kao et al.
9,434,538 B2 9/2016 Yang et al.
D770,121 S 10/2016 Chen
D771,344 S 11/2016 Yang et al.
D773,145 S 11/2016 Yang et al.
9,481,515 B2 11/2016 Yang et al.
D773,769 S 12/2016 Chen
9,573,759 B2 2/2017 Yang et al.
9,586,755 B1 3/2017 Yang et al.
D787,828 S 5/2017 Thoma et al.

(56) References Cited

U.S. PATENT DOCUMENTS

D790,145 S 6/2017 Chen
D793,642 S 8/2017 Yang et al.
D798,016 S 9/2017 Yang et al.
D804,133 S 9/2017 Yang et al.
9,751,692 B2 9/2017 Yang et al.
9,790,025 B2 10/2017 Yang et al.
9,856,080 B2 1/2018 Yang et al.
D820,544 S 6/2018 Joseph
D825,876 S 8/2018 Chen
D827,968 S 9/2018 Chen
D829,400 S 9/2018 Yang et al.
D830,029 S 10/2018 Greenspoon et al.
D835,374 S 12/2018 Yang et al.
D835,376 S 12/2018 Yang et al.
D836,278 S 12/2018 Berberet et al.
D840,628 S 2/2019 Chang
D845,576 S 4/2019 Lu
10,279,996 B2 5/2019 Yang et al.
10,279,997 B2 5/2019 Yang et al.
D851,350 S 6/2019 Lu
D853,067 S 7/2019 Chen
D855,919 S 8/2019 Yang et al.
D858,024 S 8/2019 Yang et al.
D858,923 S 9/2019 Yang et al.
D861,076 S 9/2019 Chen
10,472,170 B2 11/2019 Yang et al.
10,494,175 B2 12/2019 Yang et al.
D874,776 S 2/2020 Spadotto
10,654,648 B1 5/2020 Rodriguez
10,683,165 B2 6/2020 Yang et al.
10,723,549 B2 7/2020 Yang et al.
D901,815 S 11/2020 Yang et al.
10,906,738 B2 2/2021 Barry
11,027,916 B2 6/2021 Yang et al.
D925,153 S 7/2021 Busch
D930,933 S 9/2021 Yang et al.
11,136,186 B2 10/2021 Yang et al.
D936,927 S 11/2021 Zeng
D938,125 S 12/2021 Zhang
D939,174 S 12/2021 Zeng
11,279,555 B2 3/2022 Yang et al.
2001/0002690 A1 6/2001 Rosky
2001/0020619 A1 9/2001 Pfeifer et al.
2001/0045512 A1 11/2001 Brent
2002/0009567 A1 1/2002 Brand
2002/0066736 A1 6/2002 Pyles
2002/0092853 A1 7/2002 Wang
2002/0096523 A1 7/2002 Pyles
2002/0096524 A1 7/2002 Hardesty
2002/0100758 A1 8/2002 Pyles
2002/0104266 A1 8/2002 Ranaudo
2002/0116924 A1 8/2002 Winkelmann et al.
2002/0185199 A1 12/2002 Myers et al.
2003/0089719 A1 5/2003 Berger
2003/0102316 A1 6/2003 Forest
2003/0201265 A1 10/2003 Lin
2003/0205979 A1 11/2003 Papari et al.
2003/0230576 A1 12/2003 Lin
2004/0016756 A1 1/2004 Lin
2004/0028572 A1 2/2004 Sham et al.
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0250711 A1 12/2004 Ernst
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0129803 A1 6/2005 Umeda et al.
2005/0258177 A1 11/2005 Woodson
2005/0258794 A1 11/2005 Fukuizumi
2006/0027579 A1 2/2006 Yang et al.
2006/0103086 A1 5/2006 Niemeyer et al.
2006/0110537 A1 5/2006 Huang et al.
2006/0138149 A1 6/2006 Tracy
2006/0156948 A1 7/2006 Hendriks et al.
2006/0163257 A1 7/2006 Golbert
2006/0175336 A1 8/2006 Wang
2006/0186121 A1 8/2006 Yang et al.
2006/0196874 A1 9/2006 Yang
2006/0237641 A1 10/2006 Moeller et al.
2006/0249510 A1 11/2006 Lin
2006/0278643 A1 12/2006 Chiou
2007/0012699 A1 1/2007 Yang et al.
2007/0034334 A1 2/2007 Ramsey et al.
2007/0045326 A1 3/2007 Tramontina et al.
2007/0090112 A1 4/2007 Kalman et al.
2007/0114847 A1 5/2007 Ichimaru et al.
2007/0181579 A1 8/2007 Kuo et al.
2007/0209846 A1 9/2007 Wilson
2007/0215622 A1 9/2007 Perez
2007/0241109 A1 10/2007 Lin
2007/0266637 A1 11/2007 McGowan
2007/0272691 A1 11/2007 Wang et al.
2007/0289972 A1 12/2007 Wynn et al.
2008/0011754 A1 1/2008 Ramsey
2008/0011910 A1 1/2008 Ramsey
2008/0041863 A1 2/2008 Forest
2008/0083756 A1 4/2008 Daniels
2008/0083757 A1 4/2008 Parker et al.
2008/0099274 A1 5/2008 Seel
2008/0128428 A1 6/2008 Beckerman
2008/0164257 A1 7/2008 Boll et al.
2008/0236275 A1 10/2008 Breed et al.
2008/0245794 A1 10/2008 Escobar et al.
2008/0257889 A1 10/2008 Kovacevich et al.
2008/0257890 A1 10/2008 Kovacevich et al.
2008/0257891 A1 10/2008 Kovacevich et al.
2008/0264948 A1 10/2008 Kovacevich et al.
2008/0264950 A1 10/2008 Kovacevich et al.
2008/0272119 A1 11/2008 Efstathiou
2008/0272127 A1 11/2008 Kovacevich et al.
2009/0008888 A1 1/2009 Boulden
2009/0071959 A1 3/2009 Cheung
2009/0084788 A1 4/2009 Yang et al.
2009/0136341 A1 5/2009 Kenyon
2009/0214606 A1 8/2009 Bujard et al.
2009/0230131 A1 9/2009 McDuffie et al.
2009/0261105 A1 10/2009 Cunningham et al.
2009/0266836 A1 10/2009 Mobley
2010/0006572 A1 1/2010 Chiou
2010/0084235 A1 4/2010 Lu
2010/0096894 A1 4/2010 Fukai
2010/0122985 A1 5/2010 Peters et al.
2010/0147865 A1 6/2010 Yang et al.
2010/0170904 A1 7/2010 Kalman et al.
2010/0176126 A1 7/2010 Shikano
2010/0178105 A1 7/2010 Monneret
2010/0193518 A1 8/2010 Tontarelli
2010/0219191 A1 9/2010 Prosa
2010/0237074 A1 9/2010 Yang et al.
2010/0252557 A1 10/2010 Clements
2010/0294769 A1 11/2010 Lee et al.
2011/0017735 A1 1/2011 Wang et al.
2011/0049149 A1 3/2011 Shih
2011/0056952 A1 3/2011 Borowski et al.
2011/0139781 A1 6/2011 Jin et al.
2011/0272409 A1 11/2011 Kasbohm
2012/0111895 A1 5/2012 Fitzpatrick et al.
2012/0145932 A1 6/2012 Yao et al.
2012/0234836 A1 9/2012 Barrett et al.
2012/0234849 A1 9/2012 Hughes et al.
2012/0248149 A1 10/2012 Pelfrey
2012/0261423 A1 10/2012 Zawrotny et al.
2013/0048641 A1 2/2013 Romano
2013/0097809 A1 4/2013 Weber et al.
2013/0105487 A1 5/2013 Baik
2013/0240592 A1 9/2013 Woodruff

(56) References Cited

U.S. PATENT DOCUMENTS

| | | | | |
|---|---|---|---|---|
| 2013/0248535 | A1 | 9/2013 | Wolfe et al. | |
| 2013/0300119 | A1 | 11/2013 | Anzalon et al. | |
| 2014/0183193 | A1 | 7/2014 | Hammond et al. | |
| 2014/0238989 | A1 | 8/2014 | Wang et al. | |
| 2014/0240964 | A1 | 8/2014 | Adachi et al. | |
| 2014/0305946 | A1 | 10/2014 | Han | |
| 2014/0345453 | A1 | 11/2014 | Oh et al. | |
| 2015/0251849 | A1 | 9/2015 | Yang et al. | |
| 2015/0321841 | A1 | 11/2015 | Salas et al. | |
| 2016/0137411 | A1 | 5/2016 | Rogers | |
| 2016/0200508 | A1 | 7/2016 | Thoma et al. | |
| 2017/0050404 | A1 | 2/2017 | Henken et al. | |
| 2017/0127669 | A1 | 5/2017 | Yang et al. | |
| 2017/0166167 | A1 | 6/2017 | Heller et al. | |
| 2017/0176986 | A1 | 6/2017 | High et al. | |
| 2017/0253429 | A1* | 9/2017 | Yang | B65F 1/06 |
| 2018/0093827 | A1 | 4/2018 | Yang et al. | |
| 2018/0178978 | A1 | 6/2018 | Yang et al. | |
| 2018/0305120 | A1 | 10/2018 | Yang et al. | |
| 2019/0077595 | A1 | 3/2019 | Wang et al. | |
| 2019/0185263 | A1 | 6/2019 | Yang et al. | |
| 2020/0148467 | A1 | 5/2020 | Yang et al. | |
| 2020/0307907 | A1 | 10/2020 | Yang et al. | |
| 2020/0407159 | A1 | 12/2020 | Yang et al. | |
| 2022/0097960 | A1 | 3/2022 | Yang et al. | |
| 2022/0135321 | A1 | 5/2022 | Yang et al. | |
| 2022/0160126 | A1 | 5/2022 | Yang et al. | |

FOREIGN PATENT DOCUMENTS

| | | | | |
|---|---|---|---|---|
| CA | 2519295 | | 3/2007 | |
| CN | 2075182 | U | 4/1991 | |
| CN | 2378327 | Y | 5/2000 | |
| CN | 2467467 | Y | 12/2001 | |
| CN | 200964993 | Y | 10/2007 | |
| CN | 101177946 | A | 5/2008 | |
| CN | 201105898 | Y | 8/2008 | |
| CN | 201330049 | Y | 10/2009 | |
| CN | 201367221 | Y | 12/2009 | |
| CN | 201372076 | Y | 12/2009 | |
| CN | 201447201 | U | 5/2010 | |
| CN | 201512253 | U | 6/2010 | |
| CN | 201597962 | U | 10/2010 | |
| CN | 201907743 | U | 7/2011 | |
| CN | 202213911 | U | 5/2012 | |
| CN | 103207416 | A | 7/2013 | |
| CN | 103303618 | A | 9/2013 | |
| CN | 204587817 | U | 8/2015 | |
| CN | 205169479 | U | 4/2016 | |
| CN | 107032015 | A | 8/2017 | |
| DE | 1610087 | | 7/1950 | |
| DE | 822376 | | 11/1951 | |
| DE | 1283741 | | 7/1966 | |
| DE | 8436939 | | 3/1985 | |
| DE | 9108341 | | 10/1991 | |
| DE | 4225936 | | 2/1994 | |
| DE | 19525885 | | 3/1997 | |
| DE | 19617823 | | 11/1997 | |
| DE | 19809331 | | 5/1999 | |
| DE | 19811991 | A1 | 9/1999 | |
| DE | 29918687 | | 3/2000 | |
| DE | 19933180 | | 1/2001 | |
| DE | 10036259 | A1 | 11/2001 | |
| DE | 10148997 | | 4/2003 | |
| DE | 20305521 | U1 | 6/2003 | |
| DE | 20217561 | | 3/2004 | |
| DE | 10337806 | A1 | 3/2005 | |
| EP | 0582240 | | 7/1993 | |
| EP | 0903305 | A1 | 3/1999 | |
| EP | 0906876 | A2 | 4/1999 | |
| EP | 1094017 | A1 | 4/2001 | |
| EP | 1162161 | | 12/2001 | |
| EP | 1361176 | A1 | 11/2003 | |
| EP | 1136393 | B1 | 4/2004 | |
| EP | 1447342 | A2 | 8/2004 | |
| EP | 1600373 | A2 | 11/2005 | |
| EP | 1647503 | A1 | 4/2006 | |
| EP | 1686073 | A1 | 8/2006 | |
| EP | 1918223 | A1 | 5/2008 | |
| EP | 2343250 | A1 | 7/2011 | |
| EP | 3042864 | A1 | 7/2016 | |
| FR | 2887152 | | 12/2006 | |
| GB | 191004921 | | 6/1910 | |
| GB | 1555543 | * | 11/1979 | B65D 43/26 |
| GB | 1555543 | A | 11/1979 | |
| GB | 2384418 | | 7/2003 | |
| JP | 02-152670 | | 6/1990 | |
| JP | H06-56011 | | 8/1994 | |
| JP | 06-272888 | | 9/1994 | |
| JP | 2004-106713 | | 4/2004 | |
| JP | 2004-231237 | | 8/2004 | |
| JP | D1300450 | | 5/2007 | |
| JP | D1300451 | | 5/2007 | |
| JP | 2007-154831 | A | 6/2007 | |
| JP | D1322056 | | 2/2008 | |
| JP | D1398668 | | 10/2010 | |
| JP | 2013-231413 | A | 11/2013 | |
| JP | 2014-523329 | A | 9/2014 | |
| KR | 20040087306 | A | 10/2004 | |
| KR | 3003841370000 | | 6/2005 | |
| KR | 3004095430000 | | 3/2006 | |
| KR | 3004095430001 | | 7/2006 | |
| NL | 6908550 | | 12/1970 | |
| TW | 183920 | | 5/1992 | |
| TW | 230977 | | 9/1994 | |
| TW | 395392 | | 6/2000 | |
| TW | D112733 | | 9/2006 | |
| TW | D129485 | | 7/2009 | |
| TW | D133382 | | 2/2010 | |
| TW | D133678 | | 3/2010 | |
| TW | 145989 | | 3/2012 | |
| TW | D162495 | | 8/2014 | |
| TW | 201720729 | | 6/2017 | |
| WO | WO 92/02430 | A1 | 2/1992 | |
| WO | WO 96/33671 | | 10/1996 | |
| WO | WO 2005/080232 | A1 | 9/2005 | |
| WO | WO 2006/079263 | A1 | 8/2006 | |
| WO | WO 2007/139570 | | 12/2007 | |
| WO | WO 2009/114495 | A1 | 9/2009 | |
| WO | WO 2015/134902 | A1 | 9/2015 | |
| WO | WO 2015/138625 | A1 | 9/2015 | |
| WO | WO 2016/054109 | A1 | 4/2016 | |

OTHER PUBLICATIONS

U.S. Appl. No. 15/476,285, filed Mar. 31, 2017, Yang et al.
U.S. Appl. No. 29/583,627, filed Jun. 22, 2017, Yang et al.
U.S. Appl. No. 29/633,369, filed Jan. 12, 2018, Yang et al.
U.S. Appl. No. 29/633,372, filed Jan. 12, 2018, Yang et al.
U.S. Appl. No. 16/284,996, filed Feb. 25, 2019, Yang et al.
Trento Corner 23 Trash Can, Hailo product webpage, May 2008, http://www.hailo.de/html/default.asp?site=12_71_107&lang=en.
Simplehuman Liner Rim Dual Bucket Rectangular Recycler with Liner Pocket, Stainless Steel, 58 Liter / 15 Gallon, Item No. CW2025, www.Amazon.com, site visited Dec. 29, 2015.
Web page showing picture of Hero Bullet trash can, archived Nov. 17, 2004, downloaded from http://web.archive.org/web/20041117003115/http://www.simplehuman.com/images/hero_bullet.jpg.
Schaefer, http://www.schaeferco.com/about_rollcoaters.html, 2007, in 12 pages.
Agion Product Information Bulletin Regarding Agion Antimicrobial Type AC; publicly available at least as early as Oct. 2015 (in two pages).
Agion Material Safety Data Sheet; Agion Antimicrobial Type AC; publicly available at least as early as Oct. 2015 (in three pages).
Extended European Search Report in corresponding European Patent Application No. 19160903.1, dated Jan. 10, 2020, in 10 pages.
alzashop.com, Simplehuman 45L Pedal Rectangular White Plastic Stainless Steel Trash Can, https://www.alzashop.com/simplehuman-45l-pedal-rectangular-white-plastic-stainless-steel-d5841987.htm, site visited Jul. 20, 2021, in 3 pages.

(56) References Cited

OTHER PUBLICATIONS

Youtube.com, "Automatic trash can pull out cabinet with Arduino (DIY)", dated Oct. 9, 2019, https://www.youtube.com/watch?v=mmcgTaE45_Y, entire video, including screenshot in 1 page.
Youtube.com, "trash pullout with servo drive installed", dated Jun. 17, 2011, https://www.youtube.com/watch?v=t01SbtllEh8, entire video, including screenshots in 3 pages.

* cited by examiner

TRASH CAN ASSEMBLY

RELATED APPLICATION

This application claims the priority benefit of U.S. Provisional Patent Application No. 62/639,900, filed on Mar. 7, 2018, which is hereby incorporated by reference herein in its entirety.

BACKGROUND

Field

The present disclosure is generally related to containers, such as trash can assemblies that tend to move or shift when opened or closed.

Description of Certain Related Art

Receptacles and other devices having lids or doors are used in a variety of different settings, such as for containing refuse or for storing items such as recyclables, dirty laundry, pet food, etc. For example, in both residential and commercial settings, trash cans and other receptacles often have lids or doors for protecting or preventing the escape of the contents of the receptacle. The lid or door can also inhibit or prevent odors from escaping and can hide the items within the receptacle from view. Additionally, the lid of a trash receptacle can help prevent contamination from escaping from the receptacle.

SUMMARY OF CERTAIN EMBODIMENTS

A problem with many existing receptacles with lids, such as trash receptacles, is that the lid can contact the surrounding environment (e.g., a wall or cabinet) when the lid is actuated due to movement or shifting of the receptacle. In some circumstances, this contact can cause the receptacle to get lodged into the surrounding environment and prevent the receptacle from returning back to its original position or alignment. Several embodiments disclosed herein address this problem, or other problems.

In some embodiments, a trash can assembly comprises a body comprising an upper sidewall and a lower base, the body having a front region and a rear region. The trash can assembly can include a lid configured to transition between a closed position and an open position. The trash can assembly can include an actuation system, which can include a pedal and a linkage. The actuation system can be configured to move the lid from the closed position to the open position in response to an actuation force applied on the pedal. The trash can assembly can include a dislodgement or return system. The dislodgement or return system can have at least one dynamic member associated with the front region of the body and at least one static member associated with the rear region of the body. The active dislodgement or return system can be configured to facilitate returning the trash can assembly to an original position or alignment, for example, automatically. In some implementations, the dynamic member comprises a frame associated with the lower base of the body; a foot that is movably coupled to the frame and is movable between an extended position and a retracted position; and/or a biasing member applying a force on the foot to urge the foot into the extended position. The foot can be configured to engage a floor of a surrounding environment in one or both of the extended and retracted positions. When the actuation force is applied on the pedal, the foot can be configured to transition from the extended position to the retracted position. After the actuation force is released from the pedal, the foot can be configured to transition from the retracted position to the extended position to move the body relative to the surrounding environment.

Any of the structures, materials, steps, or other features disclosed above, or disclosed elsewhere herein, can be used in any of the embodiments in this disclosure. Any of the structures, materials, steps, or other features that are shown and/or described herein can be used in combination with any other of the structures, materials, steps, or other features that are shown and/or described herein. No structure or step is essential or indispensable.

Neither the preceding summary nor the following detailed description purports to limit or define the scope of protection. The scope of protection is defined by the claims.

BRIEF DESCRIPTION OF THE DRAWINGS

The abovementioned and other features of the embodiments disclosed herein are described below with reference to the drawings of the embodiments. The illustrated embodiments are intended to illustrate, but not to limit the embodiments. Various features of the different disclosed embodiments can be combined to form further embodiments, which are part of this disclosure.

FIG. 5 illustrates the receptacle upon application of a force to actuate a lid. FIG. 6 illustrates the receptacle lodged against a wall of the surrounding environment. FIG. 7 illustrates the active dislodgement or return system applying a dislodgement or return force. FIG. 8 illustrates the receptacle in the original position shown in FIG. 5.

DETAILED DESCRIPTION OF CERTAIN EMBODIMENTS

The embodiments disclosed herein are disclosed in the context of trash can assemblies (also called trash cans, garbage bins, refuse containers, recycling containers, or otherwise) because they have particular utility in this context. However, the inventions disclosed herein can be used in other contexts as well, such as in any other type of receptacle. Further, the inventions are described herein in reference to various embodiments and drawings. It will be appreciated by those skilled in the art that variations and improvements may be accomplished in view of these teachings without deviating from the scope and spirit of the inventions. By way of illustration, the many features are described in reference to a step-type trash container, such as a step trash can of the kind typically used in kitchens. Many types of trash containers, such as those with side-pivoting lids or removable lids, can be used in connection with the present inventions.

Overview

Figure 1:
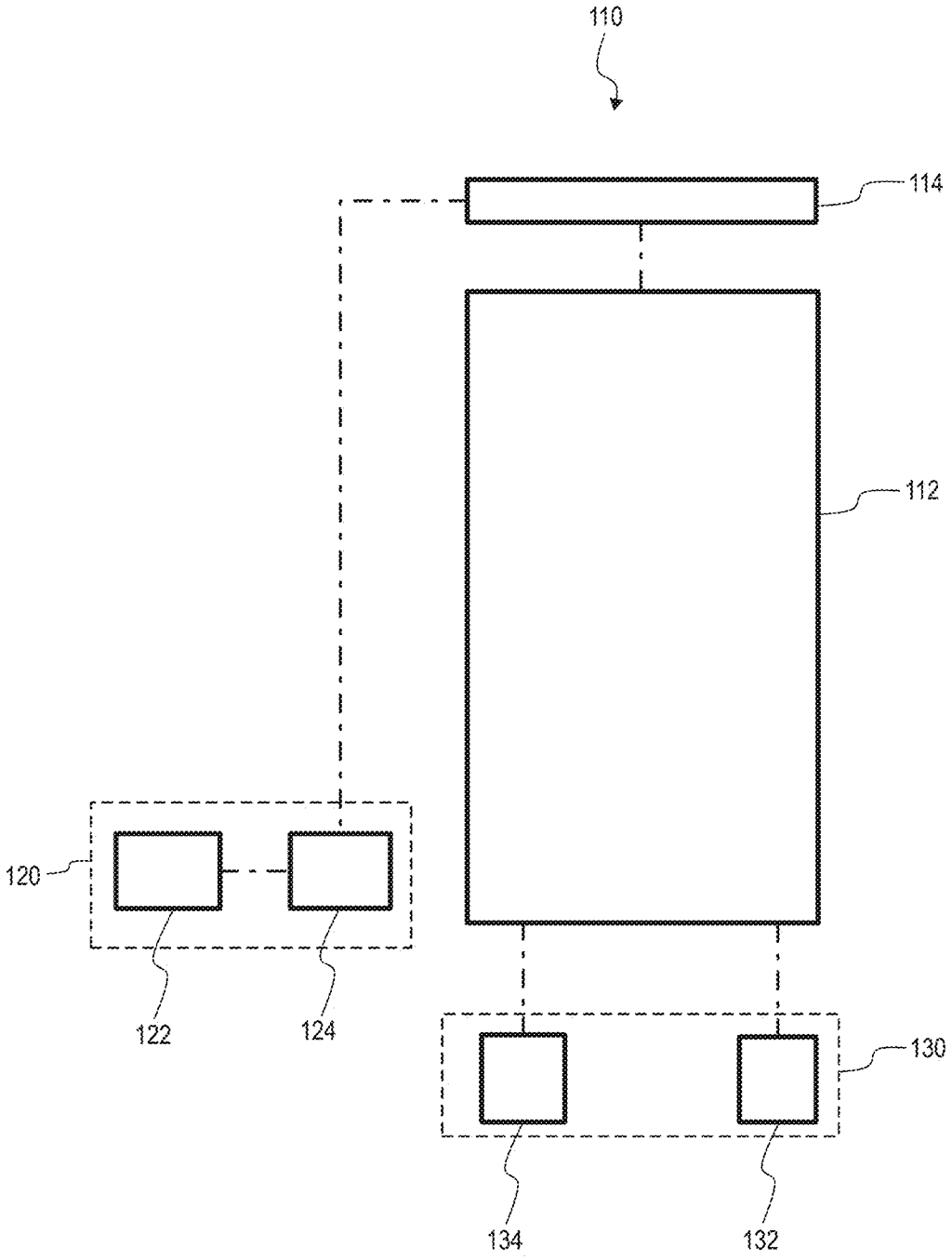
FIG. 1 illustrates a schematic of an embodiment of a receptacle having an active dislodgement or return system.

FIG. 1 illustrates a schematic representation of an embodiment of a receptacle, such as a trash can. As with all embodiments in this specification, any individual feature, step, structure, material, or method that is illustrated and/or described in FIG. 1 can be used in combination with or instead of any individual feature, step, structure, material, or method that is illustrated and/or described in any other portion of this specification and/or in U.S. Publication No. 2015/0259139, which is incorporated herein by reference in its entirety.

The trash can 110 can include a body 112 and an upper closure assembly. As shown, the upper closure assembly can be or can include a lid 114 movably coupled to the body 112 to provide access to the interior of the body 112. The lid 114 can be rotatably coupled along a rear side of the body 112. The trash can 110 can include an actuation system 120 for operating the upper closure assembly, such as the lid 114. As shown, the actuation system can include an actuator 122. For example, the actuator 122 can be a foot pedal positioned along a lower, front side of the body 112. The actuator 122 can operate the upper closure assembly via a linkage 124. In some embodiments, the linkage 124 can physically couple the actuator 122 to the upper closure assembly via one or more struts, rods, or hydraulics. However, it is to be understood that the linkage 124 can indirectly couple the actuator 122 to the upper closure assembly. For example, the actuator 122 can be used to operate an electronic motor coupled to the upper closure assembly.

As shown, the trash can 110 can include an active dislodgement or return system 130. As will be discussed in further detail below, the active dislodgement or return system 130 can facilitate dislodging the trash can 110 from the surrounding environment, such as between the floor and a wall positioned behind the body 112, or returning the trash can 110 from a temporary position, such as a position caused by temporarily opening the lid on the trash can 110. The active dislodgement or return system 130 can include one or more static members 132 and/or one or more dynamic members 134. As shown in the illustrated embodiment, the static members 132 and/or the dynamic members 134 can be attached to a lower portion of the body 112. For example, the static members 132 and/or the dynamic members 134 can contact one or more structures in the surrounding environment, such as a floor and/or a wall, and/or can be used to support the weight of the body 112 against a floor of the surrounding environment. The static members 132 can be positioned at or proximate a rear side of the body 112 and/or the dynamic members 134 can be positioned at or proximate a front side of the body 112. However, it is to be understood that the static members 132 and/or the dynamic members 134 can be attached to other portions of the body 112. For example, static members 132 can be positioned near both the front side and the rear side of the body 112 and/or dynamic members 134 can be positioned near both the first side and the rear side of the body 112. As another example, the dynamic members 134 can be positioned on sidewall, such as a rear sidewall of the body 112.

The static members 132 can generally retain their shape when subjected to a load. For example, the static members 132 can be formed from a material which experiences little to no deformation when a force is applied on the actuator 122. In some embodiments, the static members 132 and/or the dynamic members 134 may be formed at least in part from a polymer or elastomer or any other slip-resistant material having a high coefficient of friction, such as plastic or rubber, which can be attached directly to the body 112. In some implementations, the static members 132 can maintain the same general shape throughout operation of the trash can 110 (e.g., before and after actuation of the actuation system 120).

The dynamic members 134 can move in response to an environmental stimulus, such as an action by a user or the ceasing of an action by a user. For example, structures of the dynamic members 134 can translate and/or rotate upon release of a force on the actuator 122. In some implementations, structures of the dynamic members 134 can translate and/or rotate upon application of a force on the actuator 122.

Schematics of a Dynamic Member

Figure 4:
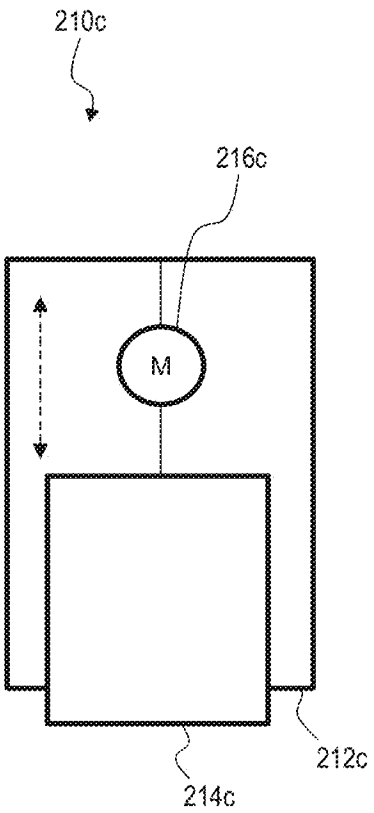
FIG. 4 illustrates a schematic of another embodiment of a motorized dynamic member of an active dislodgement or return system.
Figure 3:
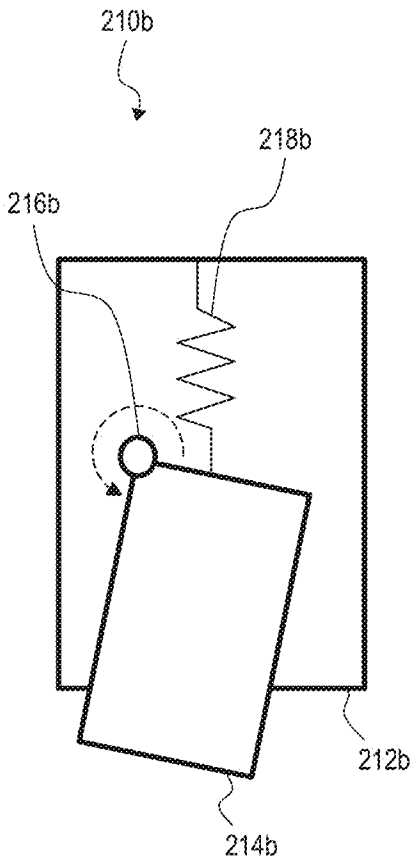
FIG. 3 illustrates a schematic of an embodiment of a rotatable dynamic member of an active dislodgement or return system.
Figure 2:
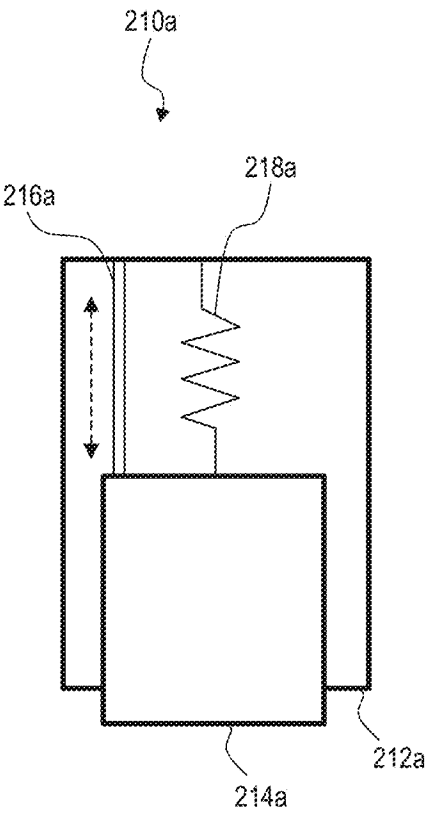
FIG. 2 illustrates a schematic of an embodiment of a translatable dynamic member of an active dislodgement or return system.

FIGS. 2-4 illustrate various embodiments of dynamic members 210*a*-210*c*. Although these embodiments are discussed separately, it is to be understood that any individual feature, step, structure, material, or method of an embodiment may be used in combination with or instead of any individual feature, step, structure, material, or method of another embodiment described herein.

With reference first to FIG. 2, dynamic member 210*a* can include a frame 212*a* and a foot 214*a* at least partially received within the frame 212*a*. As shown, the foot 214*a* can translate at least vertically relative to frame 212*a*. For example, the foot 214*a* can translate upwardly towards a retracted position and downwardly towards an extended position. In some embodiments, the foot 214*a* can translate along a rail 216*a* to facilitate transitioning between the retracted and extended positions.

The dynamic member 210*a* can include a biasing member 218*a* to bias the foot 214*a* into a desired position. In some embodiments, the biasing member 218*a* can bias the foot 214*a* towards the extended position. This can advantageously allow the biasing member 218*a* to apply a counteracting force on the foot 214*a* when the foot 214*a* is in a retracted position. For example, in some implementations where the dynamic member is positioned below the body of the trash can 110, the foot 214*a* can transition from an extended position to a retracted position upon application of a downward force on the trash can 110 (e.g., a downward force on the actuator 122 of FIG. 1 to open the lid 114). In some embodiments, the downward force can be at least about 6 pounds and/or less than or equal to about 10 pounds. Upon release of this downward force, the biasing member 218*a* can push the foot 214*a* back towards the original, extended position. In some embodiments, the movement of the dynamic member 210*a* and/or the movement of the foot 214*a* and/or the application of a restoring force by the dynamic member 210*a* can tend to dislodge a trash can 110 if the trash can 110 is lodged against a wall of the surrounding environment, or can otherwise help to return a trash can 110 to its starting or original position. In some embodiments, the trash can 110 and/or the dynamic member 210*a* can travel generally horizontally (e.g., along the ground or other supporting surface) at least about 2 mm and/or less than or equal to about 4 mm, back and forth upon application and release of the downward force on the actuator 122 and/or upon actuation and release of the dynamic member 210*a*.

With reference next to FIG. 3, a dynamic member 210*b* can include a frame 212*b* and a foot 214*b* at least partially received within the frame 212*b*. As shown, the foot 214*b* can rotate relative to frame 212*b*. For example, the foot 214*b* can rotate counter-clockwise towards a retracted position and clockwise towards an extended position, and/or the rotation or angular displacement of the foot 214*b* relative to the frame can be at least about 5 degrees and/or less than or equal to about 10 degrees. In some embodiments, the foot 214*b* can translate along a pivot 216*b* coupling the foot 214*b* to the frame 212*b*. Similar to dynamic member 210*a*, the dynamic member 210*b* can include a biasing member 218*b* to bias the foot 214*b* into a desired position. In some embodiments, the biasing member 218*b* can bias the foot 214*b* towards the extended position.

With reference next to FIG. 4, a dynamic member 210*c* can include a frame 212*c* and a foot 214*c* at least partially received within the frame 212*c*. As shown, the foot 214*c* can translate at least vertically relative to the frame 212*c*. For example, the foot 214*c* can translate upwardly towards a retracted position and downwardly towards an extended position. The dynamic member 210*c* can include an electronic component 216*c*, such as a motor or solenoid, to move the foot 214*c* into a desired position. For example, in some implementations where the dynamic member is positioned below the body of the trash can 110, the foot 214*c* can transition from the retracted position to an extended position upon release of a downward force on the trash can 110 (e.g., a downward force on the actuator 122 of FIG. 1 to open the lid 114). In some embodiments, the foot 214*c* can transition from the retracted position to the extended position upon detecting that the trash can 110 is lodged against a wall of the surrounding environment. For example, a sensor can be included on the dynamic member 210*c* and/or trash can 110. This sensor can detect the angular orientation, or other property, of the trash can 110. The movement of the foot 214*c* and/or the application of force by the electronic component 216*c* can tend to dislodge the trash.

While the embodiments of dynamic members 210*a-c* are described as having frames 212*a-c*, it is to be understood that the frames 212*a-c* can be omitted. Many different types of dynamic members can be used in any suitable situation to achieve biased horizontal travel in a trash can 110 in order to return the trash can 110 from a displaced position to a substantially original position, such as a piston or plunger (e.g., with a slanted surface that contacts the ground or other supporting surface), a moveable linkage (e.g., a four-bar linkage), and/or one or more gears or wheels, etc. Any components of the illustrated dynamic members 210*a-c*, such as the feet 214*a-c*, biasing members 218*a-b*, and/or electronic component 216*c*, can be omitted or substituted or can be attached directly to the trash can 110. Moreover, while the biasing members 218*a-b* are schematically illustrated as a coil spring, it is to be understood that the biasing member can take on any other forms such as, but not limited to, one or more radial springs, leaf springs, elastomeric members, and the like. Moreover, it is to be understood that the biasing member can include devices or structures that induce and/or respond to electromagnetic forces. For example, the biasing member can include one or more magnets attached to the frame and foot which are oriented to attract or repel, one or more solenoids, and/or one or more electric motors.

Operational Examples of a Receptacle with a Dynamic Member

FIGS. 5-8 provide a schematic representation of the operation of an embodiment of a receptacle, such as a trash can 310, which has an active dislodgement or return system. As with all embodiments in this specification, any individual feature, step, structure, material, or method that is illustrated and/or described in FIGS. 5-8 can be used in combination with or instead of any individual feature, step, structure, material, or method that is illustrated and/or described in any other portion of this specification and/or in U.S. Publication No. 2015/0259139, which has been incorporated herein by reference in its entirety.

Figure 5:
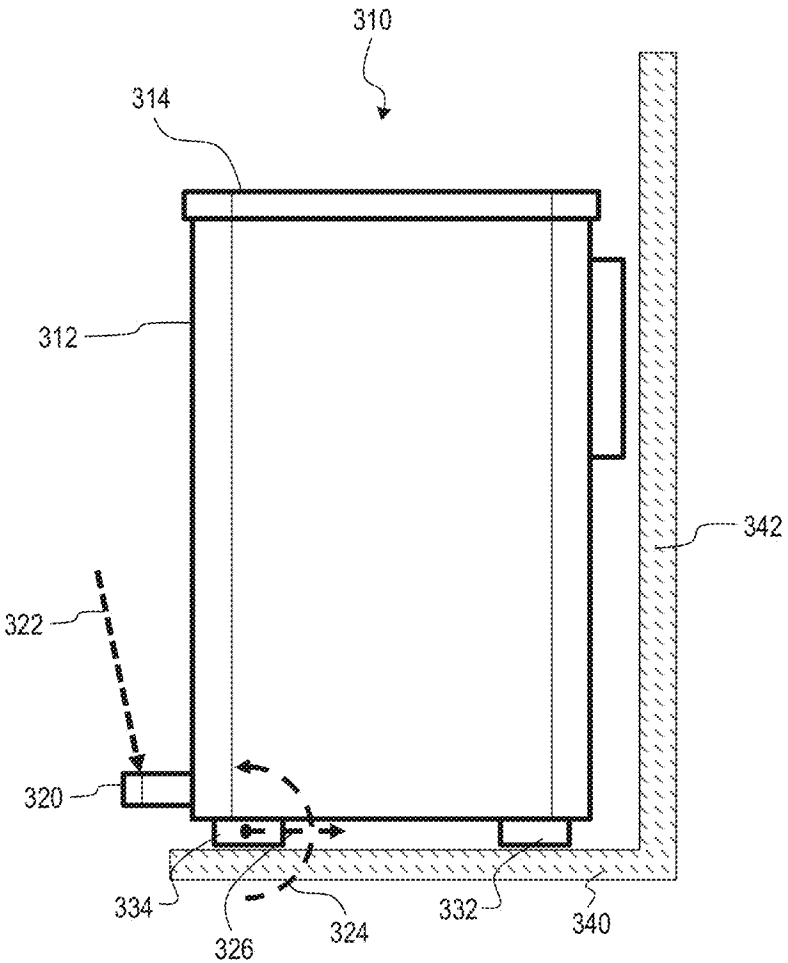

With reference first to FIG. 5, the trash can 310 is illustrated in an initial position. The trash can 310 can include a body 312 and a lid 314 which is movably coupled to the body 312. The trash can 310 can include an actuation system for operating the lid 314. As shown, the actuation system can include an actuator 320 in the form of a pedal positioned along a lower, front side of the body 312. The actuator 320 can operate the upper closure assembly via a linkage (not shown) by applying a downwardly-directed force 322 on the actuator 320.

The trash can 310 can include an active dislodgement or return system having one or more static members 332 and/or one or more dynamic members 334. As shown in the illustrated embodiment, the static members 332 and/or the dynamic members 334 are attached to a lower portion of the body 312. The static members 332 are positioned closer to a rear side of the body 312. The dynamic members are positioned closer to the front side of the body 312. In this configuration, the static members 332 and the dynamic members 334 can be used to support the weight of the body 312 against a floor 340 of the surrounding environment.

As shown, the application of a downwardly-directed force 322 on the actuator 320 can create a moment 324 about the front support elements (e.g., the dynamic members 334). In some instances, particularly when the trash can 310 is empty, this moment 324 can rotate the trash can 310 about the front support elements. This rotation can reduce the amount of grip on the floor 340, causing the trash can 310 to slide backwards into the wall 342 of the surrounding environment. Moreover, in some instances, the force 322 applied by the user may not be directed perpendicular to the floor but may instead also include a component in the direction of the wall 342. This can apply a force 326 to the front support elements which can also cause the trash can 310 to slide backwards into the wall 342 of the surrounding environment.

Figure 6:
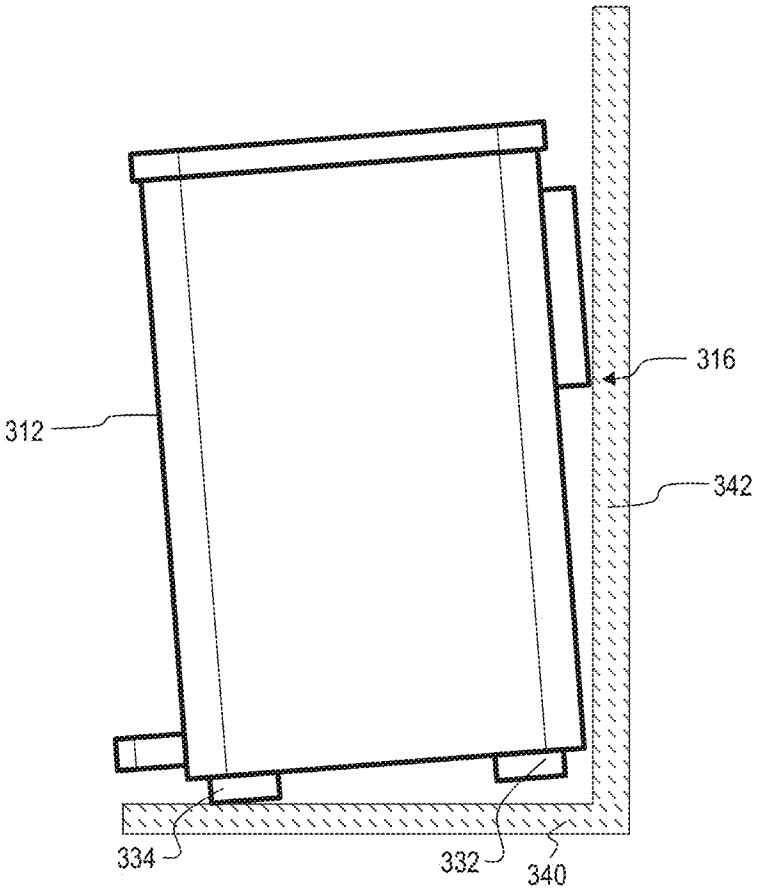
FIGS. 5-8 provide a schematic representation of the operation of an embodiment of a receptacle having an active dislodgement or return system.

With reference next to FIG. 6, as illustrated, the trash can 310 is lodged against the wall 342 due to the translation and rotation discussed above. As shown, a rear portion 316 of the body 312 is lodged against the wall 342. In some instances, the trash can 310 is inhibited from returning back to the initial position shown in FIG. 5 due to friction between the front supporting element (e.g., dynamic members 334) and the floor 340.

Figure 8:
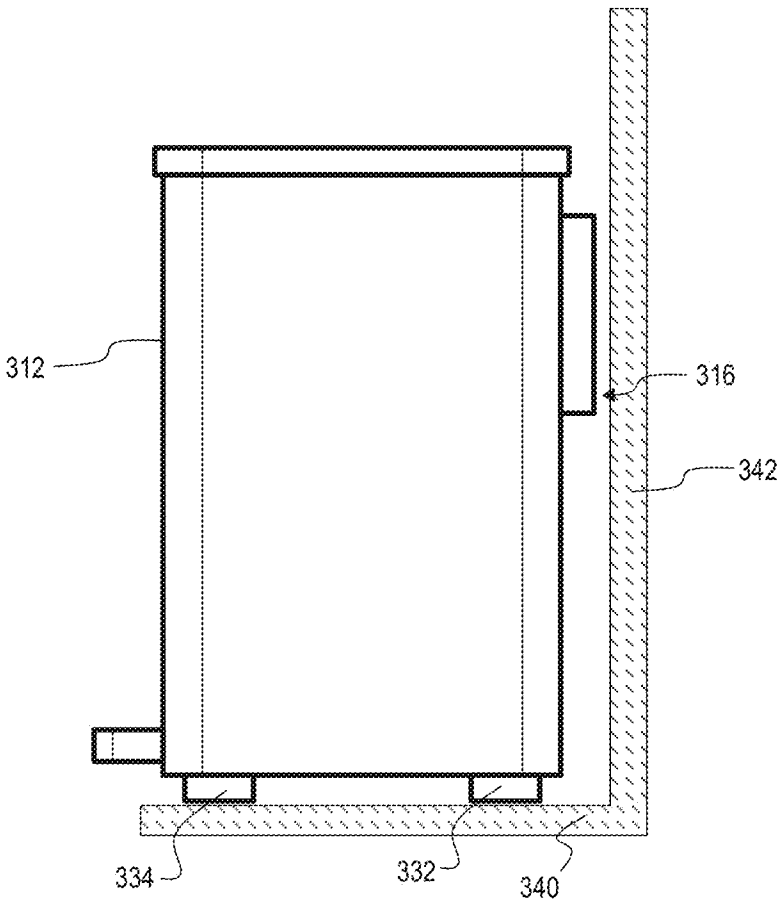
Figure 7:
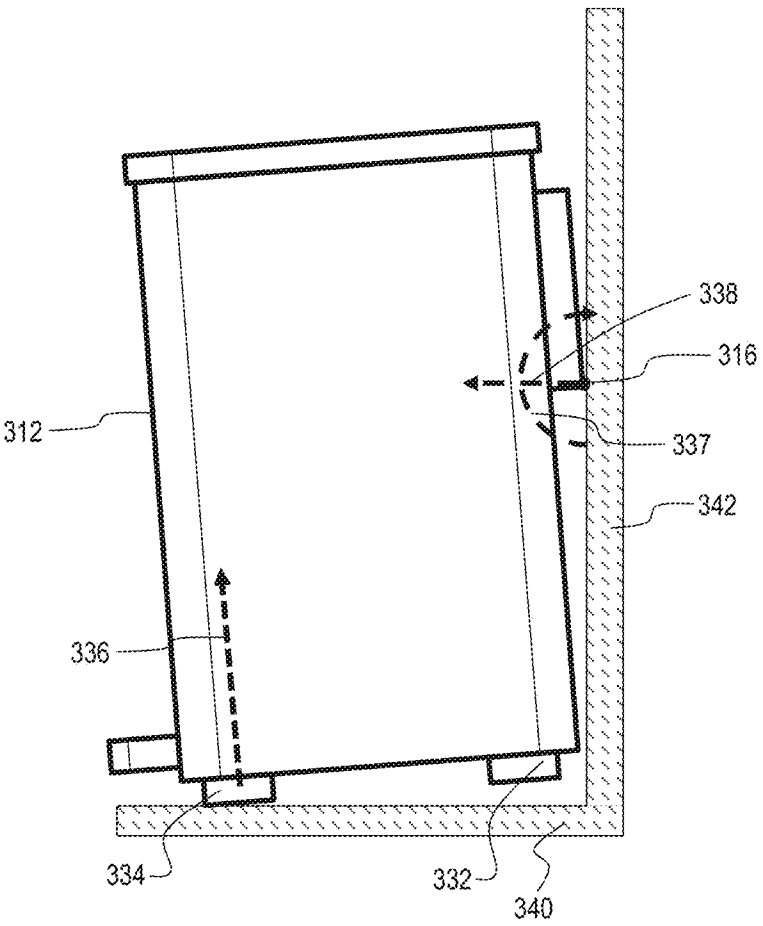

With reference next to FIG. 7, operation of the dynamic members 334 is shown in greater detail. The dynamic members 334 can apply a force 336 against the body 312 in an upward direction and/or against the floor 340 in a downward direction (e.g., can push against the floor 340). The application of an upwardly-directed force 336 on the body 312 can create a moment 337 about the point (or points) of contact between the body 312 and the wall 342. This moment 337 can rotate the trash can 310 about the point (or points) of contact as shown, which can reduce the amount of friction between the body 312 and the wall 342, causing the trash can 310 to slide back, become dislodged, and/or return into the original position. As used herein, the phrase "return to an original position" (and related or similar terms) refers to the action of bringing the trash can 310 to or near a location, orientation, alignment, or other condition where it began or previously was, but does not require that the trash can 310 come back to the exact same location, orientation, alignment, or other condition so long as a comparable arrangement and usage is achieved. In some implementations, the force 336 applied by the dynamic member 334 can include a horizontal component. For example, the force 336 applied by the dynamic member 334 can include a component away from the wall 342. This force can tend to move the trash can 310 away from the wall 342 as reflected by the arrow 338. The application of force 336 and/or movement of the dynamic member 334 can shift the lodged trash can 310 at least into an upright position, and preferably back to its initial position as shown in FIG. 8. In various embodiments, the operation of the dynamic members 334 shifts the lodged trash can 310 automatically, such as without additional interaction from a user.

In some embodiments, the application of force 336 can be caused by potential energy stored during compression of a biasing member (such as biasing members 218*a-b*) within the dynamic member 334. In some embodiments, the application of force 336 can be caused by an electronic device, such as a motor or solenoid, moving a component of the dynamic member 334. It is to be understood that while FIGS. 6 and 7 are shown separately, in some embodiments, the application of force 336 by the dynamic member 334 can occur immediately after release of the force 322 on the actuator 320.

Examples of Receptacles

Figure 9:
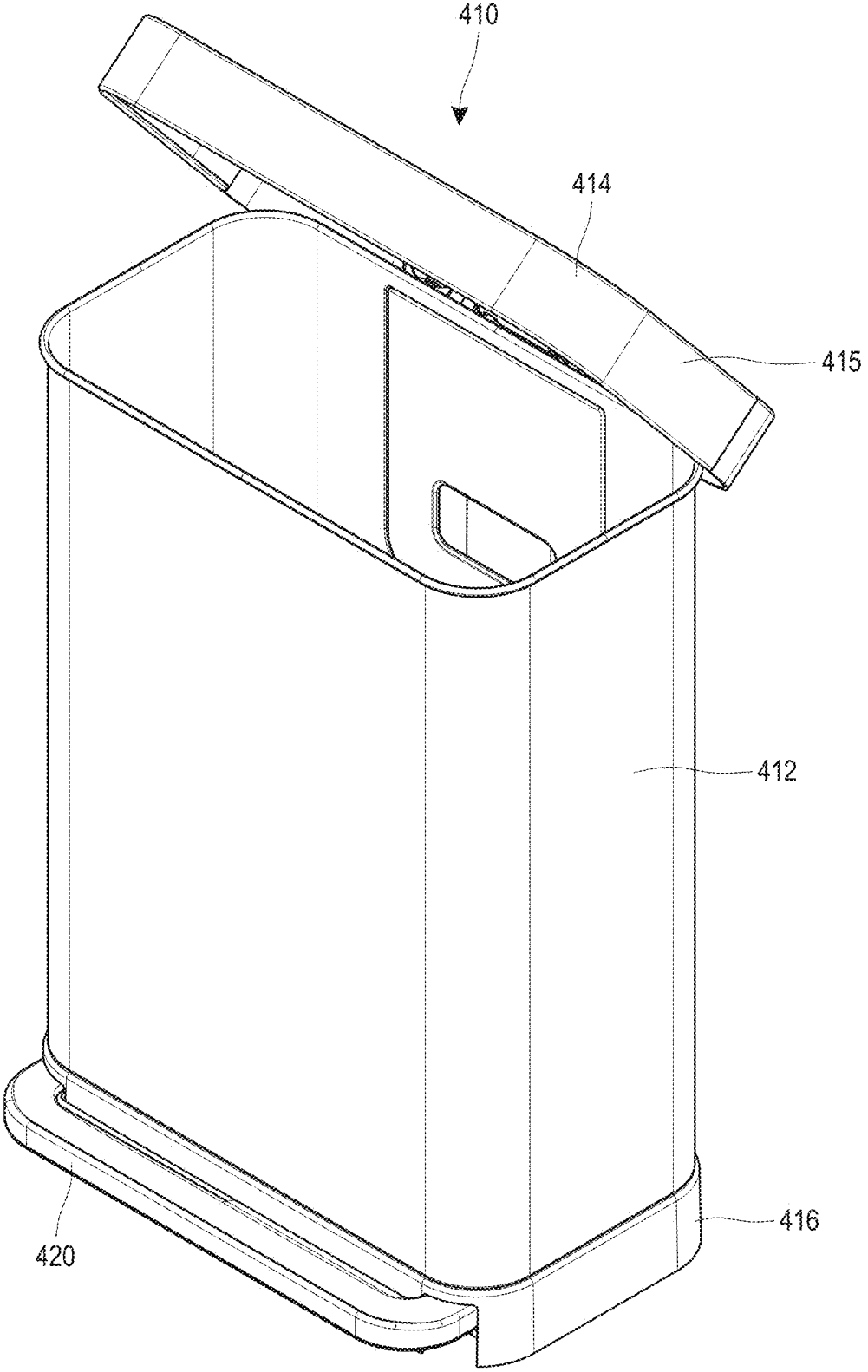
FIG. 9 illustrates a front perspective view of another embodiment of a trash can, including a movable trim ring in an open position.
Figure 10:
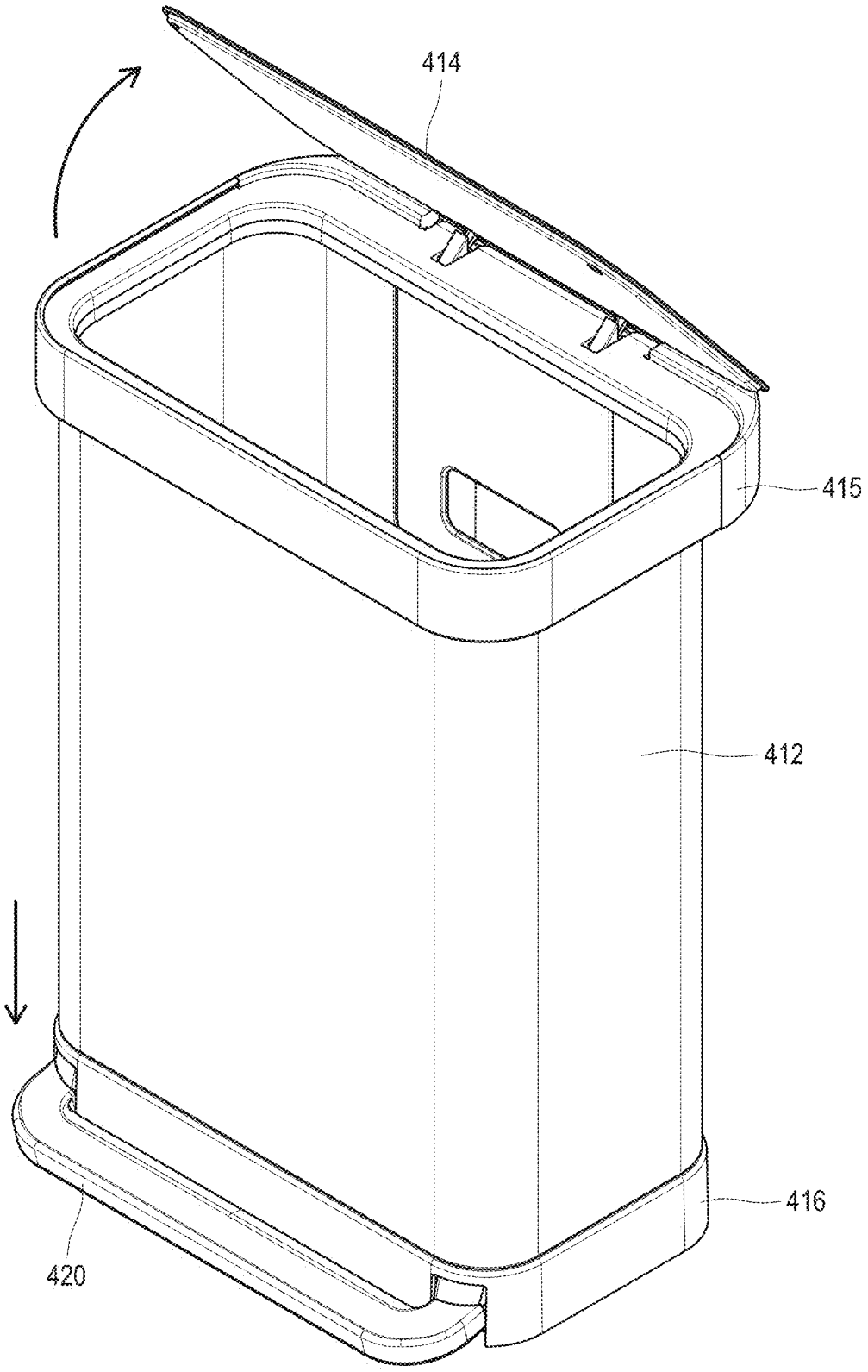
FIG. 10 illustrates a front perspective view of the trash can of FIG. 9 with the trim ring in a closed position and a lid in an open position.

FIGS. 9-13 illustrate another embodiment of a receptacle such as a trash can. As with all embodiments in this specification, any individual feature, step, structure, material, or method that is illustrated and/or described in FIGS. 9-13 can be used in combination with or instead of any individual feature, step, structure, material, or method that is illustrated and/or described in any other portion of this specification and/or in U.S. Publication No. 2015/0259139, which has been incorporated herein by reference in its entirety. As shown in FIG. 9, the trash can 410 can include a body 412 and an upper closure assembly. In some embodiments, as illustrated, the body 412 has at least two main parts: an upper sidewall and a lower base. The lower base can include a base support 416. The upper sidewall can be made of a material that is different from the lower base. For example, the upper sidewall can be made of a metal, such as stainless steel or aluminum, and/or the base can be made of a polymer such as plastic. The trash can 410 can include an aperture 425 that is configured to permit the passage of trash bags or liners from the exterior of the trash can 410 to an interior region of the trash can 410, such as in other embodiments that are illustrated and/or described in this specification.

The upper closure assembly can include multiple parts, such as a trim ring 415 that is rotatable or otherwise moveable with respect to the body 412, and a lid 414 that is rotatable or otherwise moveable with respect to the body 412. The trash can 410 may also include an actuator such as a pedal 420 that is configured to permit a user to actuate a function of the trash can 410, such as opening one or more portions of the closure assembly of the trash can 410, such as opening the lid 414 of the trashcan 410. In some embodiments (not shown), there may be multiple actuators, such as multiple pedals, that may actuate a plurality of different functions of the trash can 410, such as opening the lid 414 and/or the trim ring 415 of the trash can 410. In some embodiments (not shown), the body 412 of the trash can 410 can be split into two or more receptacles.

As illustrated in FIG. 9, the trim ring 415 can comprise a wide band that extends generally around the entire periphery of at least the front and sides of an upper portion of the body 412 of the trash can 410. The outer perimeter of the trim ring 415 can be larger than the outer perimeter of the upper portion of the body 412, as shown; or the outer perimeter of the trim ring 415 can be approximately the same size as or smaller than the outer perimeter of the upper portion of the body 412. As illustrated, the outer contours of the trim ring 415 can generally correspond to the outer contours of the upper region of the body 412.

In some embodiments, the trim ring 415 is configured to move between a closed position (as illustrated, for example, in connection with the trim ring 115 of FIGS. 18-24 of U.S. Publication No. 2015/0259139, which has been incorporated herein by reference) and an open position (as illustrated, for example, in FIG. 9). In the closed position, a top edge or top region of the trim ring 415 can be generally horizontal and/or generally perpendicular to the vertical sidewall of the body 412. In some embodiments, in the closed position, the trim ring 415 can extend downwardly along or overlap at least a portion of the upper region of the body 412. As shown, the vertical height of the trim ring 415 can be approximately the same as the vertical height of the base of the trash can 410, although other height dimensions are possible for either or both of these components, if even present.

In some embodiments, the trash can 410 does not include a removable rigid liner inside of the trash can 410 for receiving disposable trash bags or liners; rather, the trash can 410 is configured to receive an upper edge of the disposable trash bags or liners directly around the outer perimeter of the upper edge of the body 410 itself. When an upper edge of a trash bag or liner (not shown) is positioned around the upper edge of the body 410, a portion of the trash bag or liner may be exposed on the outside of the upper region of the body 410, which may present an undesirable aesthetic appearance. Conveniently, when the trim ring 415 is in the closed position, it can be configured to cover, obscure, and/or to securely hold the exposed portion of the disposable trash bag or liner along the upper region of the body 410. In some embodiments, as illustrated, the vertical length of the trim ring 415 is sufficiently long to cover or obscure any exposed portion of the upper edge of the disposable trash bag or liner when the trim ring 415 is in the closed position.

Figure 11:
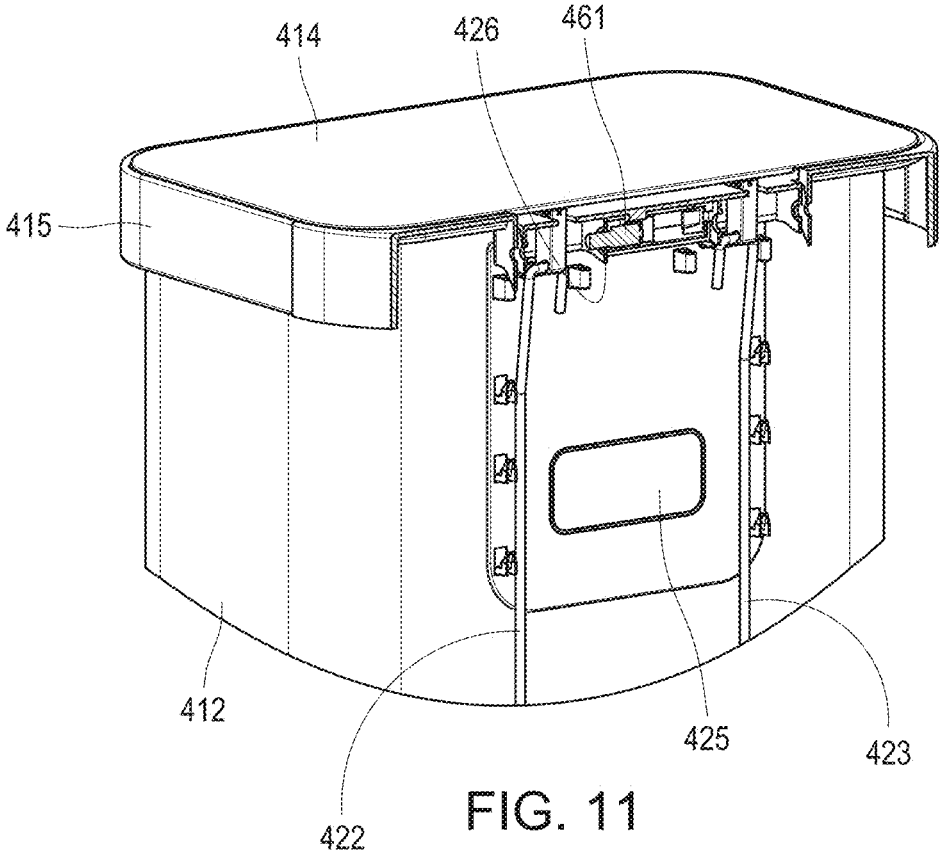
FIG. 11 illustrates a rear perspective cut-away view of a top portion of the trash can of FIG. 9.
Figure 12:
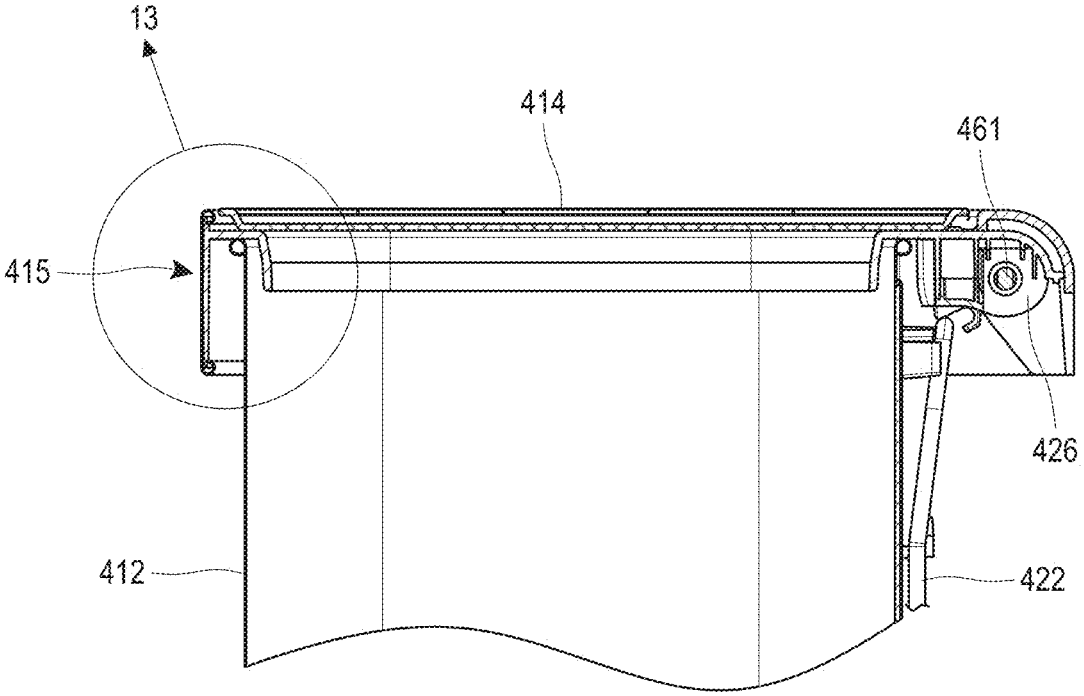
FIG. 12 illustrates a left-side cross-sectional view of a top portion of the trash can of FIG. 9.
Figure 13:
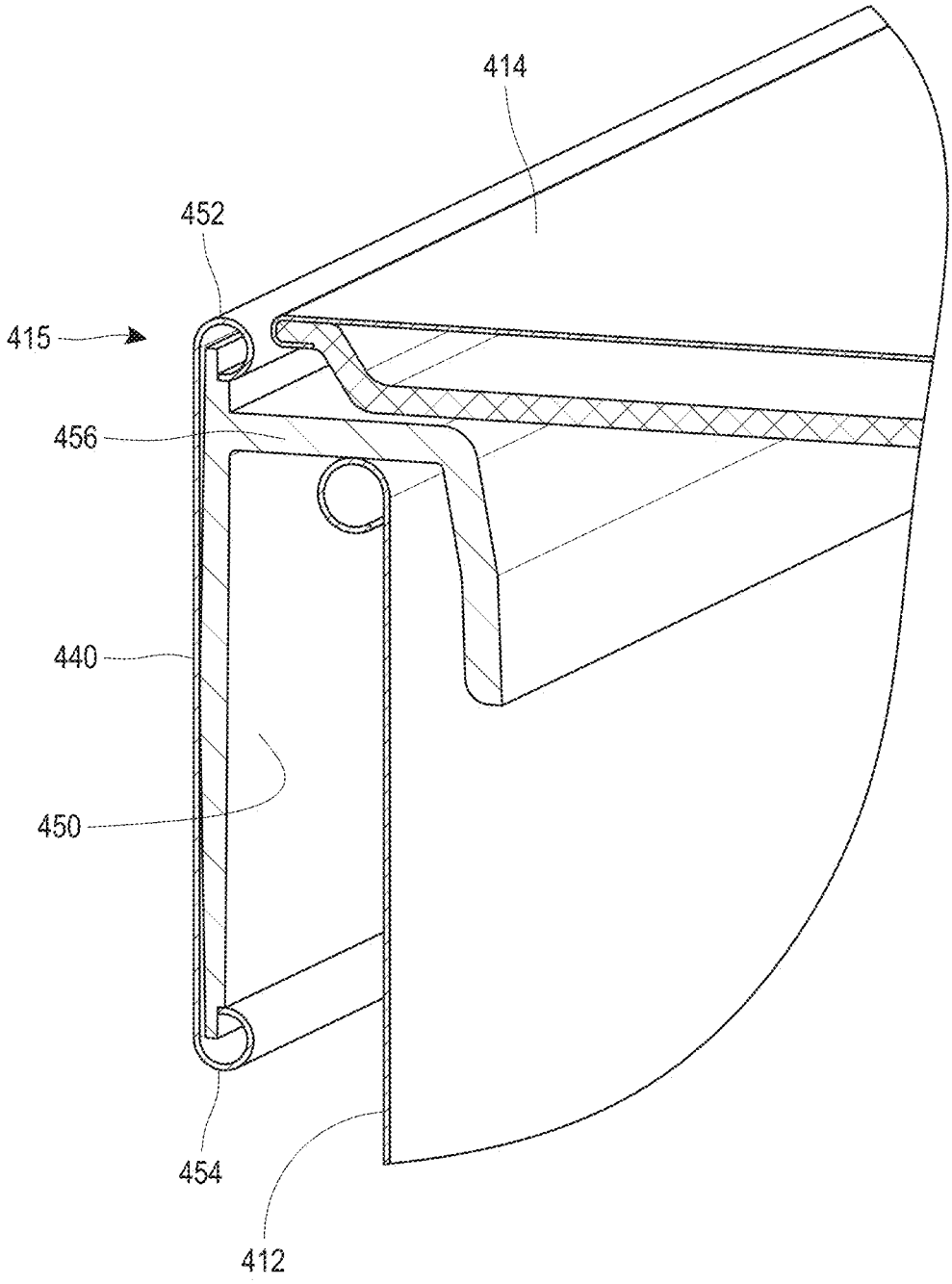
FIG. 13 illustrates a cross-sectional view of a detail section as shown in FIG. 12.

As shown in FIG. 11, which is a rear cut-away illustration of the trash can 410, the trim ring 415 and/or the lid 414 can be rotatably or pivotally or otherwise moveably attached to the trash can 410 along a rear side of the trash can 410. The pedal 420 can be directly or indirectly attached to a force-transferring system, such as one or more linkages 422, 423, that is or are configured to transfer force from the actuation of the pedal to the lid 414 to urge the lid 414 to temporarily pivot upwardly into an open position. As illustrated in FIGS. 11-13, at least a portion of the lid 414 can be positioned to contact and rest upon an interior ledge region 456 of the trim ring 415, and/or to nest at least partially within an upper region 456 of the trim ring 415. In some embodiments, as shown in FIGS. 11-13, the lid 414 and the trim ring 415 can together form a generally continuous exterior without protruding edges. For example, the uppermost edge of the trim ring 415 can be positioned at about the same vertical level as the uppermost surface of the lid 414.

Figure 19:
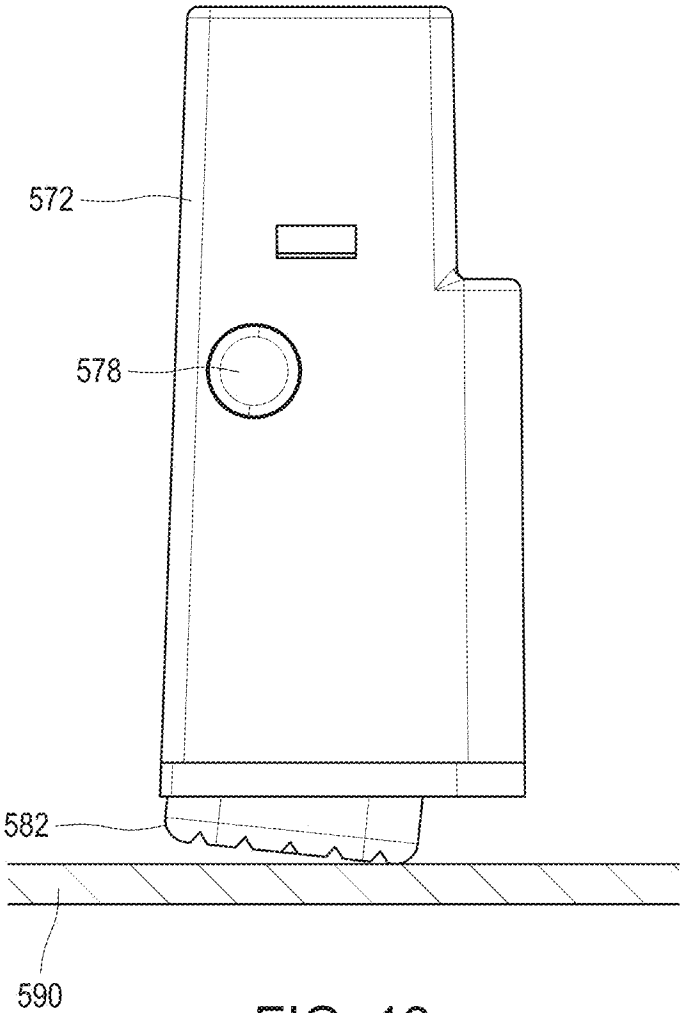
FIG. 19 illustrates a right side view of the dynamic member of FIG. 15 in a first position.

The lid 414 can be directly or indirectly attached to a damper, as illustrated, for example, in connection with the dampening mechanism 160 of FIG. 19 of U.S. Publication No. 2015/0259139, which has been incorporated herein by reference, or any other type of damper. In some embodiments, the damper can help to slow down the closing and/or opening of the lid 414 to diminish noise and/or undesired knocking of the lid 414 against an adjacent wall or cabinet or furniture. The damper can be positioned at or near the bottom region or base of the trash can 410 of FIGS. 9-13, or in any other suitable position, such as in a top or middle region of the trash can 410.

In some embodiments, as shown, the lid 414 can be pivotally attached to the trim ring 415, which in turn can be pivotally attached to the body 412 of the trash can 410. The trim ring 415 can be manually moved by a user from the closed position to the open position, as shown in FIG. 9, such as by grasping a side or front region of the trim ring 415, and rotating it upwardly. In some embodiments (not shown), the opening and/or closing of the trim ring 415 can be actuated in another way, such as with an actuator (e.g., a foot pedal, a lever, an electric motor, or some other actuation device). In some embodiments, the trim ring 415 can lock into or be held by the closure assembly in a temporarily open position to provide an opening that is sufficiently wide at the top of the trash can 410 to enable a user to maneuver around the top region of the trash can 410 in order to install a trash bag or liner along the top region of the trash can 410, without significant obstruction by the trim ring 415. The temporary locking or holding of the trim ring 415 can be accomplished, at least in part, by an actuator (e.g., a sliding switch, dial, or lever, electronic button, etc.) or by a particular manual movement of the trim ring 415 to engage a locking or holding mechanism (e.g., by pushing the trim ring 415 in a rearward direction after rotating it upwardly into the opened position).

As shown in FIGS. 11 and 12, the trim ring 415 can include a dampening mechanism, such as a damper 461, to slow down the opening and/or closing of the trim ring 415. The damper 461 can be directly or indirectly attached to a movement component 426, such as a hinge or pivot component, of the closure assembly. As illustrated, the damper 461 can be a rotation damper, which can provide rotational resistance against a torque applied to the movement component 426. Any suitable type of dampening mechanism can be used instead of or in addition to the rotational damper 461, such as an air damper, a liquid damper, or a spring damper. As illustrated, the trash can 410 can comprise at least two dampers: a first damper for dampening the opening and/or closing movement of the lid 414, and a second damper for dampening the opening and/or closing movement of the trim ring 415. In some embodiments, as illustrated, the lid 414 and trim ring 415 can move independently of each other, such that the lid 414 can be open while the trim ring 415 is closed, and/or the lid 414 can be closed while the trim ring 415 is open. Many other variations from those illustrated are possible. For example, either or both of the trim ring 415 and/or lid 414 can be omitted entirely; the lid 414 can be attached to the trash can 410 independently of the trim ring 415; the lid 414 and trim ring 415 can be damped using the same dampening mechanism, etc.

As shown in FIG. 13, the trim ring 415 can be formed from a plurality of different materials. For example, the trim ring 415 can comprise an exterior panel 440 and an interior panel 450. In some embodiments, the exterior and interior panels 440, 450 can be formed from different materials. For example, the exterior panel 440 can be formed from a metal, such as stainless steel or aluminum, and the interior panel 450 can be formed from a polymer, such as a plastic. In some embodiments, as shown, the exterior panel 440 can be substantially thinner than the interior panel 450. A metallic exterior panel 440 can provide a desirable aesthetic appearance and/or can be easier to clean or to maintain clean than a polymer exterior panel; however, metallic materials can be more expensive, heavier, and/or more difficult or more expensive to mold into a particular functional shape than a polymer material. On the other hand, a plastic interior panel 450 can be less expensive, light-weight, and easy to mold into a particular functional shape than a metallic material, such as in forming a hinge or attachment member in the pivot or movement region of the trim ring 415 or other component.

The exterior panel 440 can be attached to the interior panel 450 in many different ways. For example, the exterior panel 440 can be adhered onto an exterior face of the interior panel 450, such as using any suitable type of glue or tape or other adhesive; or the exterior panel 440 can be mechanically affixed onto the interior panel 450, such as by a snap fit, or by a friction fit, or by fasteners such as one or more screws, rivets, brads, etc. In some embodiments, the exterior panel 440 can be attached to the interior panel 450 in such a way that, as illustrated, the upper edge 452 and/or lower edge 454 of the trim ring 415 are covered (at least partially, or along a majority or their respective lengths, or at least along a majority of the front and lateral side regions, or substantially entirely) by the exterior panel 440, at least along the front and/or lateral sides of the upper region of the trash can 410. In some embodiments, the rear side of the interior panel 450 of the trim ring 415 is not covered by the exterior panel 440 (as shown). In some embodiments, the interior panel 450, which may not be as aesthetically pleasing as the exterior panel 440, is not exposed to outside view, including along at least a portion of, or a majority of, or the entirety of, the upper edge 452 and/or the lower edge 454 of the trim ring 415, at least on the front and/or lateral sides of the trash can 410. In some embodiments, as shown, the exterior panel 440 is attached to the interior panel 450 by curling a portion of an upper edge 452 of the exterior panel 440 around an upper edge of the interior panel 450 and/or by curling a portion of a lower edge 454 of the exterior panel 440 around a lower edge of the interior panel 454. In some embodiments, as shown, the upper and/or lower edges 452, 454 of the exterior panel are rounded, as illustrated in FIGS. 12-13.

In some embodiments, as shown in FIG. 13, the lid can comprise a least two components: an interior portion and an exterior portion. The interior and exterior portions can be made of different materials. For example, the interior portion can be made of a thick polymer, such as plastic, and the exterior portion can be made of a thin metal, such as aluminum or stainless steel. As illustrated, the trim ring 415 and the lid 414 can be formed and oriented such that only a metallic appearance on both of these components is visible from the exterior (at least on the front and/or lateral sides) when the lid 414 and trim ring 415 are both in closed positions.

Figure 14:
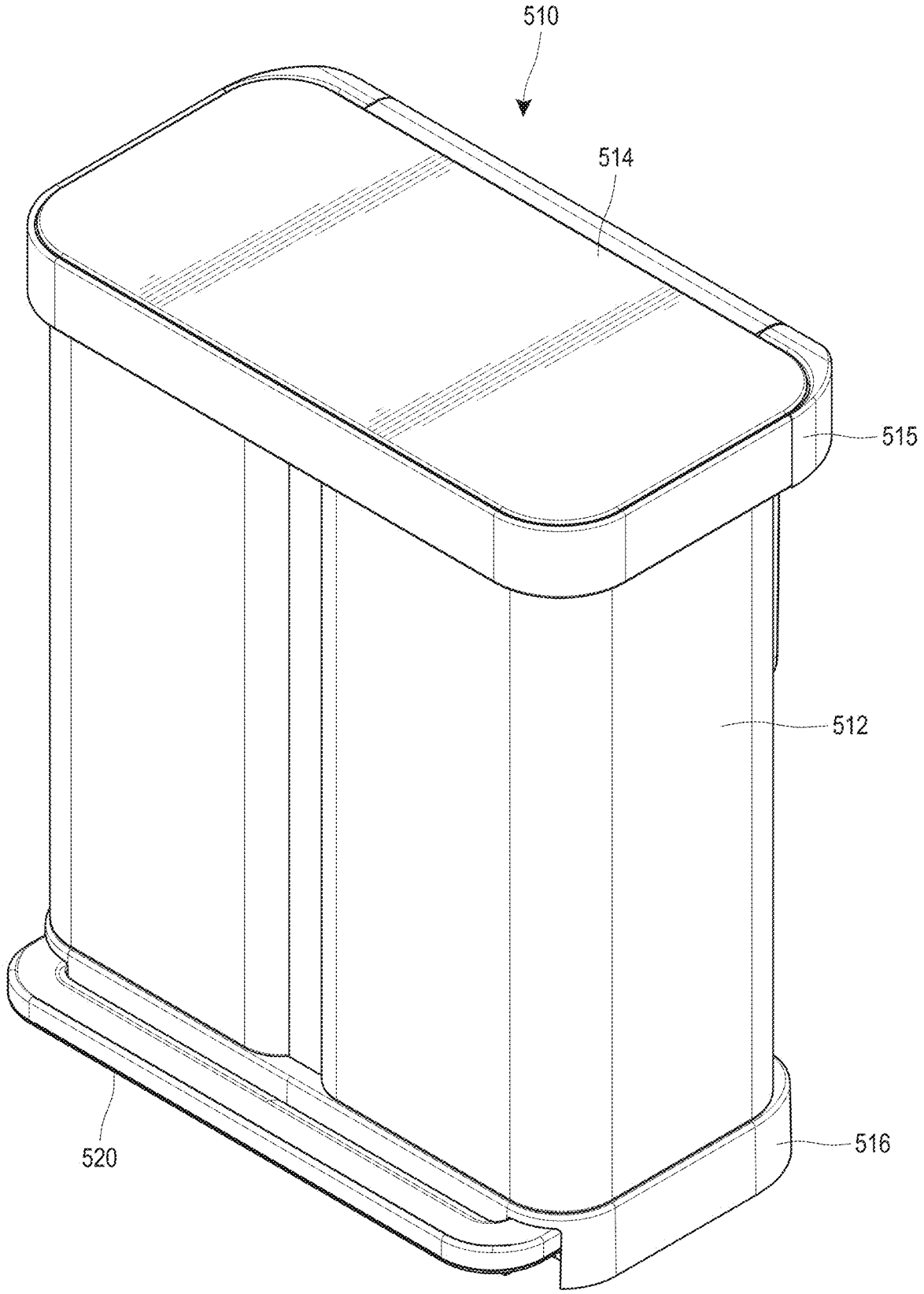
FIG. 14 illustrates a front perspective view of another embodiment of a trash can.

FIGS. 14-20 illustrate another embodiment of a receptacle such as a trash can. As with all embodiments in this specification, any individual feature, step, structure, material, or method that is illustrated and/or described in FIGS. 14-20 can be used in combination with or instead of any individual feature, step, structure, material, or method that is illustrated and/or described in any other portion of this specification and/or in U.S. Publication No. 2015/0259139, which has been incorporated herein by reference in its entirety. As shown in FIG. 14, the trash can 510 can include a body 512 and an upper closure assembly. In some embodiments, as illustrated, the body 512 has at least two main parts: an upper sidewall and a lower base. The lower base can include a base support 516. As shown, the body 512 of the trash can 510 can be split into two or more receptacles.

The upper closure assembly can include multiple parts, such as a trim ring 515 that is rotatable or otherwise moveable with respect to the body 512, and a lid 514 that is rotatable with respect to the body 512. The trash can 510 may also include an actuator such as a pedal 520 that is configured to permit a user to actuate a function of the trash can 510. As shown, the pedal 520 is positioned along a lower, front side of the trash can 510 which can facilitate operation with a user's foot; however, it is to be understood that the pedal 520 can be positioned along other locations of the body 512.

Figure 15:
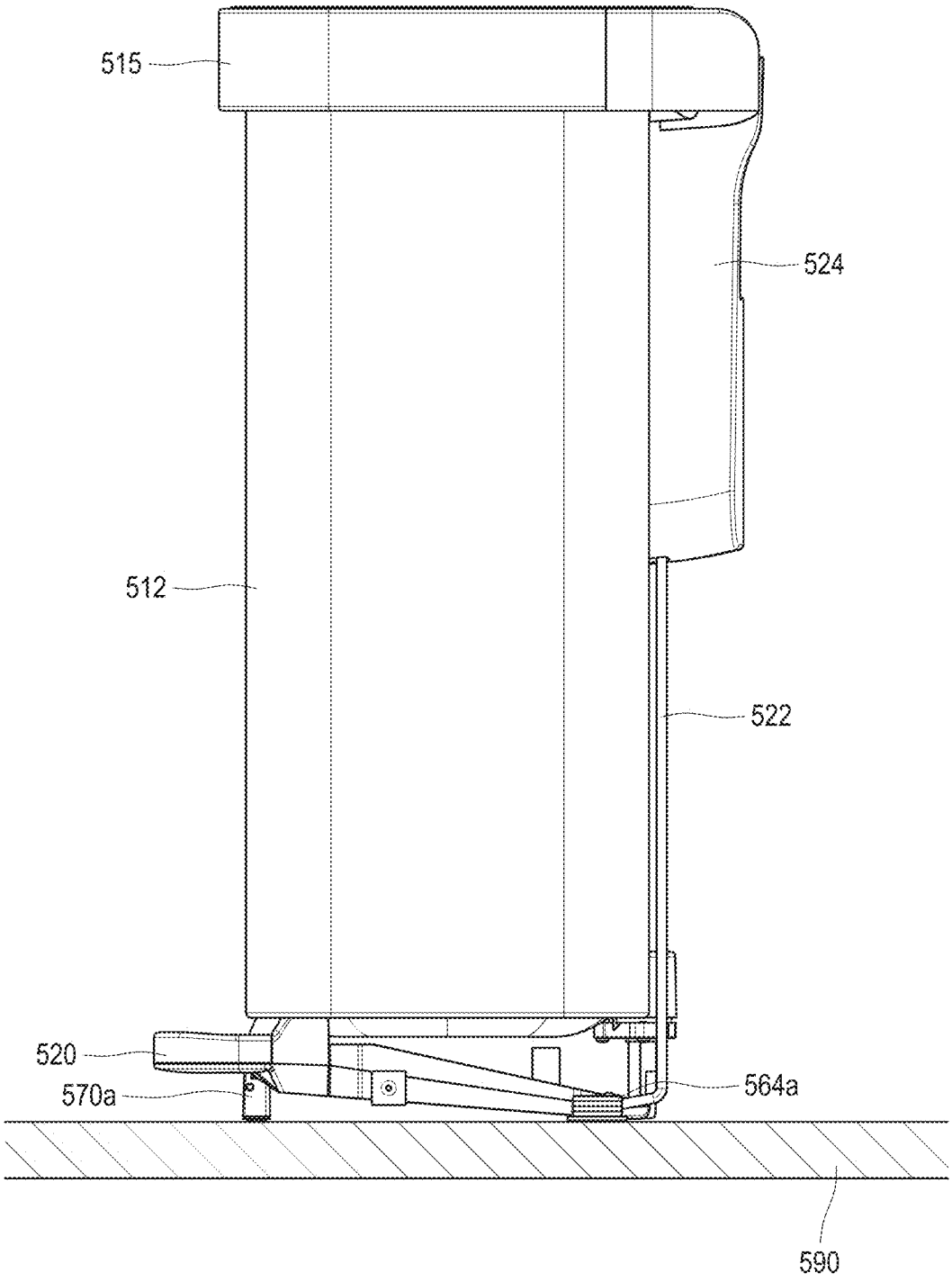
FIG. 15 illustrates a right side view of the trash can of FIG. 14 with the base support removed.

As shown in FIG. 15, which is a side view of the trash can 510 without the base support 516, the trim ring 515 and/or the lid 514 can be rotatably or pivotally or otherwise moveably attached to the trash can 510 along a rear side of the trash can 510. The pedal 520 can be directly or indirectly attached to a force-transferring system, such as one or more linkages 522 that is or are configured to transfer force from the actuation of the pedal 520 to the lid 514 to urge the lid 514 to temporarily pivot upwardly into an open position. The trash can 510 can include a housing 524 having an aperture (not shown). In some implementations, the housing 524 can be used to store trash bags or liners for use within an interior region of the trash can 510.

Figure 16:
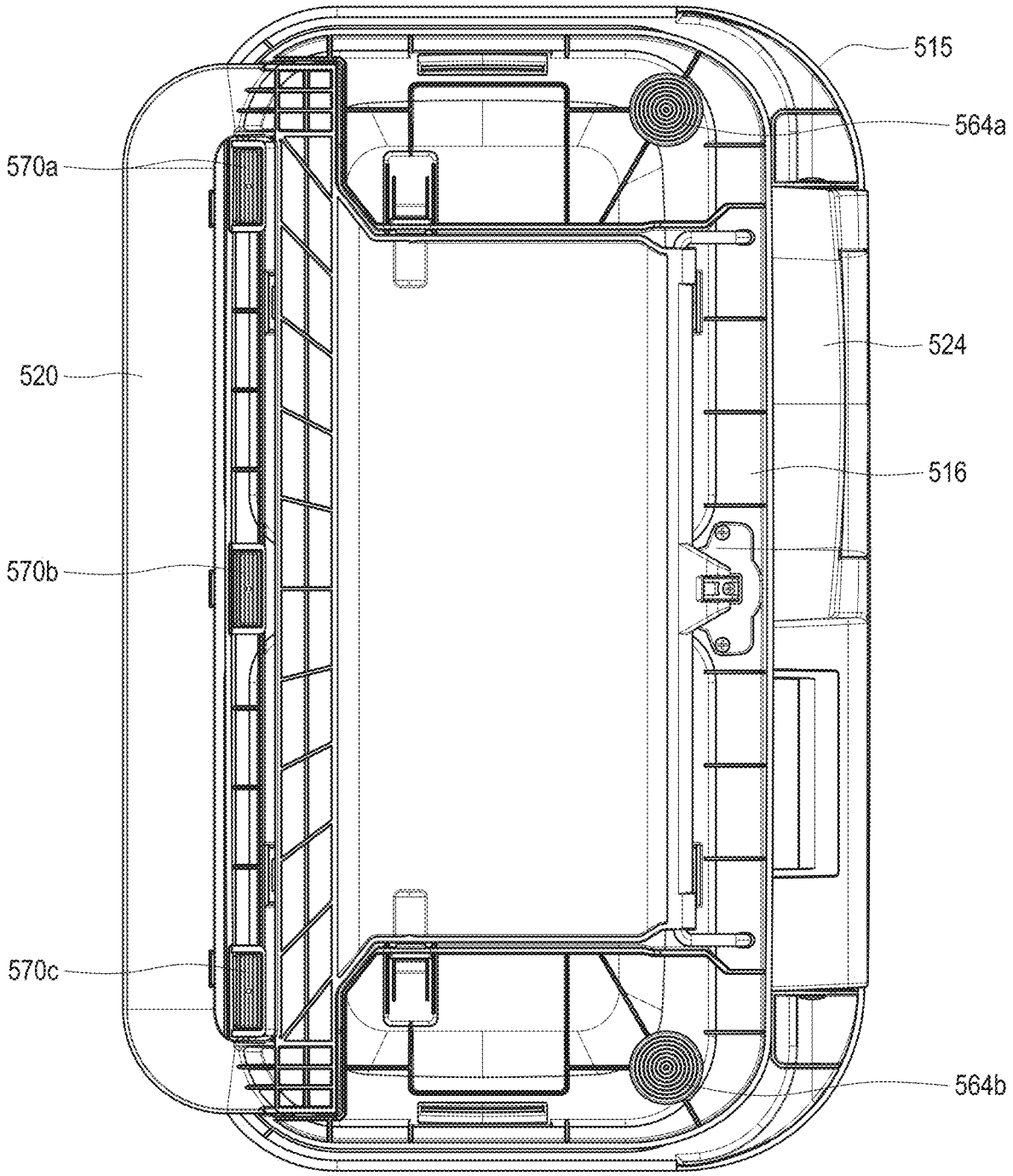
FIG. 16 illustrates a bottom view of the trash can of FIG. 14.

With reference to FIGS. 15 and 16, the trash can 510 can include an active dislodgement or return system. Components of the active dislodgement or return system can be retained or coupled to the base support 516. The active dislodgement or return system can include one or more static members 564*a* and/or one or more dynamic members 570. One or more of the static members 564*a-b* and/or the dynamic members 570*a-c* can engage the floor 590 of the surrounding environment and support the weight of the trash can 510. As shown, the static members 564*a-b* are positioned at or proximate a rear side of the trash can 510. The static members 564*a-b* can be an insert for the base support. Preferably, the static members 564*a-b* are formed from a material having a high coefficient of static and/or kinetic friction, such as rubber; however, it is to be understood that other types of materials can be used. The dynamic members 570*a-c* can be positioned at or proximate a front side of the body 512. In some embodiments, the dynamic members 570*a-c* can be positioned at or proximate the pedal 520. This can beneficially enhance the stability of the trash can 510 and/or allow a greater degree of force to be transferred to the dynamic members 570*a-c* during operation of the trash can 510. In some embodiments, the dynamic members 570*a-c* can be shaped to be inserted into a cavity of the base support 516.

An Embodiment of a Dynamic Member

Figure 17:
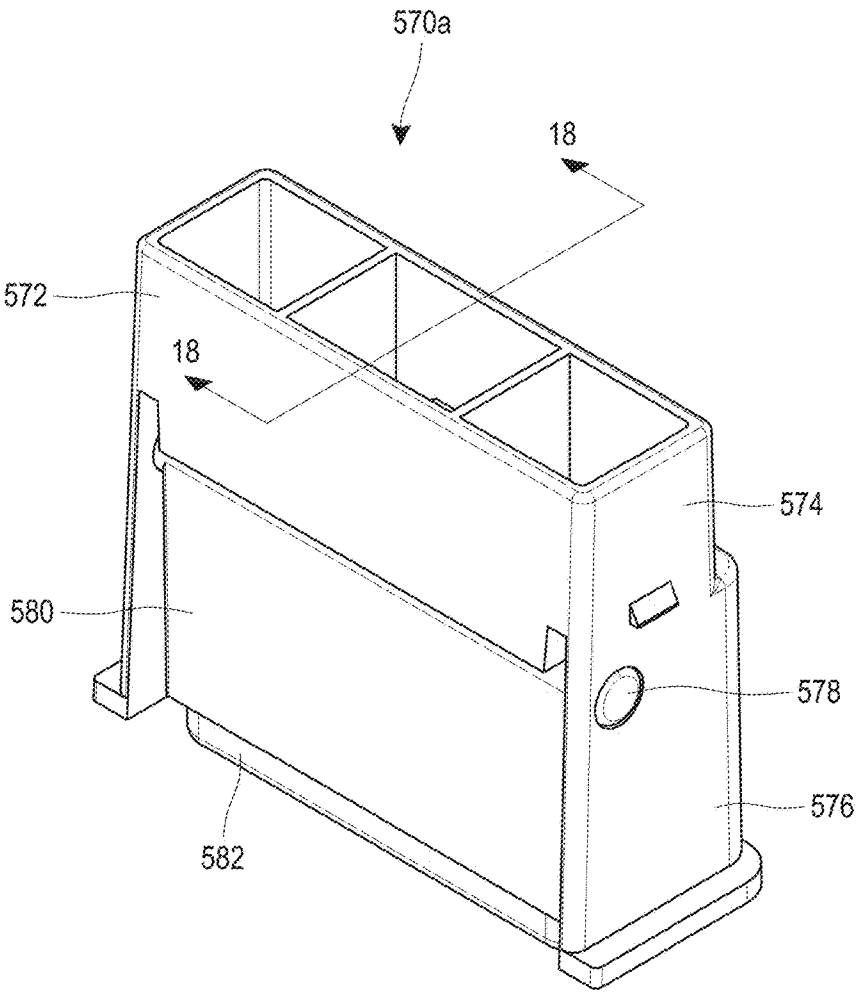
FIG. 17 illustrates a perspective view of the dynamic member of FIG. 15.

With reference next to FIGS. 17-20, an embodiment of a dynamic member, such as dynamic member 570*a*, is illustrated. With reference first to FIG. 17, the dynamic member 570*a* can include a frame 572 having an upper portion 574 and a lower portion 576. The upper portion 574 of the frame 572 can be shaped to match a portion of the base support (not shown) to allow the frame 572 to be coupled to the base support. For example, the frame 572 can be attached to the base support via a friction fit or with fasteners including, but not limited to, mechanical and/or chemical fasteners. The dynamic member 570*a* can include a movable foot having a support 580 and a traction member 582. The support 580 can be formed from a more rigid structure to enhance durability of the foot during operation. The traction member 582 can be used to engage a surface of the surrounding environment, such as the floor. The traction member 582 can be formed from a material having a high coefficient of static and/or kinetic friction, such as rubber. However, it is to be understood that other types of materials can be used.

Figure 20:
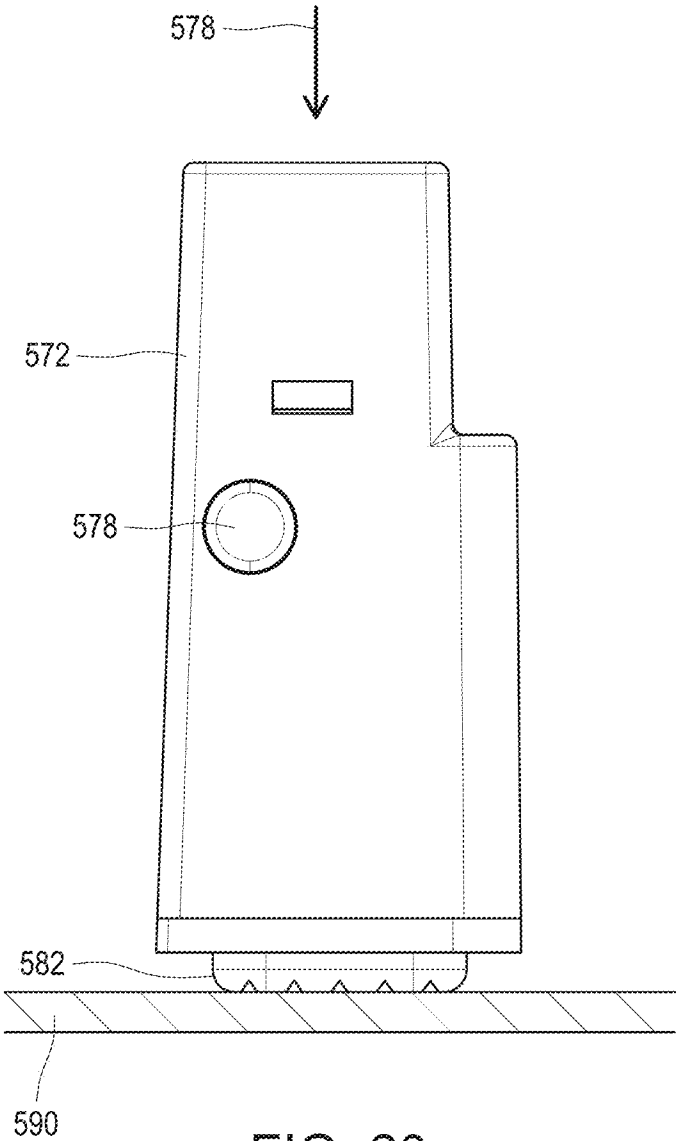
FIG. 20 illustrates a right side view of the dynamic member of FIG. 15 in a second position.

As shown, the foot can rotate relative to the frame 572. For example, the foot can rotate counter-clockwise from an extended position (as shown in FIG. 19) towards a retracted position (as shown in FIG. 20) and return back to the extended position by rotating clockwise. The foot can be coupled to the frame 572 via a pivot 578, such as a pivot pin received within an opening of the frame 572. The pivot 578 can be unitarily formed with the support 580; however, it is to be understood that the pivot 578 can be a separate component which couples the support 580 to the frame 572.

Figure 18:
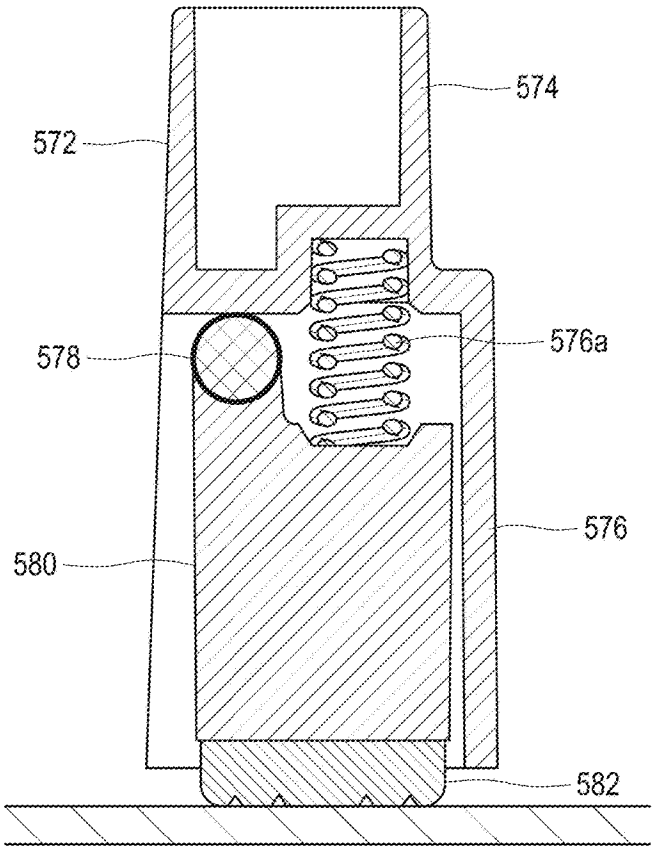
FIG. 18 illustrates a cross-sectional view of the dynamic member of FIG. 15.

With reference next to FIG. 18, the dynamic member 570*a* can include a biasing member 576*a* to bias the foot into a desired position. In some embodiments, the biasing member 576 can bias the foot towards the extended position (e.g., in a clockwise direction). This can advantageously allow the biasing member 576 to apply a counteracting force on the foot when the foot is in a retracted position. For example, in some implementations where the dynamic member is positioned below the body of the trash can, the foot 214*a* can transition from an extended position to a retracted position upon application of a downward force (578 in FIG. 20) on the dynamic member 570*a*. In some instances, this downward force can be caused by actuation of the pedal to operate the trash can 510. Upon release of this downward force, the biasing member 576 can push the foot back towards the original, extended position. As discussed above, the movement of the foot and/or the application of this force can tend to dislodge a trash can if the trash can is lodged against a wall of the surrounding environment.

In some implementations, the surface area of the dynamic member 570*a* in contact with the surface, such as the floor 590, can change as the dynamic member 570*a* transitions between the extended position and the retracted position. For example, as shown in FIG. 20, the traction member 582 can substantially contact the floor 590 when the dynamic member 570*a* is in a retracted position. In some instances, this can beneficially increase the amount of traction force provided by the traction member 582 when a downward force 578 is applied. This can be particularly advantageous in reducing rearward sliding of the trash can 510 when a user applies a downward force on pedal 520 to operate the trash can 510.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

Several illustrative embodiments of dynamic foot trash can assemblies and associated methods have been disclosed. Although the trash cans have been disclosed in the context of certain embodiments and examples, it will be understood by those skilled in the art that the trash cans extend beyond the specifically disclosed embodiments to other alternative embodiments and/or uses of the embodiments and certain modifications and equivalents thereof. For example, although generally rectangular trash cans are depicted, the disclosed inventive concepts can be used in connection with a wide variety of trash can configurations, such as circular, semi-circular, oval, etc. Various features and aspects of the disclosed embodiments can be combined with or substituted for one another in order to form varying modes of a receptacle or trash can. The scope of this disclosure should not be limited by the particular disclosed embodiments described herein.

While this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and not all operations need to be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and other implementations of the disclosed features are within the scope of this disclosure.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of trash can assemblies have been disclosed. Although the trash cans have been disclosed in the context of those embodiments and examples, it will be understood by those skilled in the art that this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The following is claimed:

1. A trash can assembly comprising:

a body comprising an upper sidewall and a lower base, the body having a front region and a rear region;

a lid configured to transition between a closed position and an open position;

an actuation system comprising a pedal and a linkage, the actuation system configured to move the lid from the closed position to the open position in response to an actuation force applied on the pedal; and an active dislodgement or return system comprising a dynamic member associated with the front region of the body and a static member associated with the rear region of the body, the active dislodgement or return system configured to facilitate returning the trash can assembly to an original position or alignment, the dynamic member comprising:

a frame associated with the lower base of the body;

a foot movably coupled to the frame, the foot being rotatable between an extended position and a retracted position, the foot configured to engage a floor of a surrounding environment in both the extended and retracted positions; and a biasing member applying a force on the foot to urge the foot into the extended position, wherein the trash can assembly is configured such that:

in response to the actuation force being applied to the pedal, the foot transitions from the extended position to the retracted position; and in response to the actuation force being released from the pedal, the foot transitions from the retracted position to the extended position, thereby moving the body relative to the surrounding environment.

2. The trash can assembly of claim 1, wherein the foot is configured to translate between the extended position and the retracted position.

3. A trash can assembly configured for use on a floor and to automatically dislodge from a wall, the trash can assembly comprising:

a body comprising a front, a rear, and a lower base, the rear being configured to be positioned adjacent the wall;

a lid coupled with the body, the lid configured to move between a closed position and an open position;

an actuation system comprising an actuator and a linkage, the actuation system configured to rotate the lid from the closed position to the open position in response to an actuation force applied to the actuator; and a dynamic member coupled to a lower base of the body, the dynamic member comprising:

a foot configured to rotate relative to the body between an extended position and a retracted position and configured to engage the floor in both the extended and retracted positions; and a biasing member applying a force on the foot to urge the foot into the extended position;

the dynamic member being configured such that:

when the actuation force is applied to the actuator, the foot transitions from the extended position to the retracted position, and after the actuation force is released from the actuator, the foot transitions from the retracted position to the extended position, thereby pushing on the floor and moving the body relative to the wall.

4. The trash can assembly of claim 3, wherein the dynamic member is coupled to the lower base at or proximate a front side of the body.

5. The trash can assembly of claim 3, wherein the foot is configured to translate relative to the body.

6. The trash can assembly of claim 3, wherein the biasing member comprises a spring.

7. The trash can assembly of claim 3, further comprising a static member configured to engage the floor.

8. A trash can assembly comprising:

a body comprising an upper sidewall and a lower base;

a lid coupled with the body, the lid configured to move between a closed position and an open position;

an actuation system comprising an actuator and a linkage, the actuation system configured to rotate the lid from the closed position to the open position in response to an actuation force applied to the actuator; and an active dislodgement or return system comprising a dynamic member coupled to a lower base of the body, the dynamic member comprising a spring, the dynamic member being rotatable, relative to the body, from a retracted position to an extended position to facilitate dislodging the body from a surrounding environment.

9. The trash can assembly of claim 8, wherein movement of the dynamic member from the retracted position to the extended position is configured to move the body relative to the surrounding environment.

10. The trash can assembly of claim 8, wherein the dynamic member is configured to transition from the extended position to the retracted position in response to the actuation force being applied on the actuator.

11. The trash can assembly of claim 8, wherein the dynamic member is configured to transition towards the extended position after release of the actuation force on the actuator.

12. The trash can assembly of claim 8, wherein the dynamic member is configured to translate relative to the body of the trash can assembly.

13. A trash can assembly comprising:

a body comprising an upper sidewall and a lower base;

a lid coupled with the body, the lid configured to move between a closed position and an open position;

an actuation system comprising an actuator and a linkage, the actuation system configured to rotate the lid from the closed position to the open position in response to an actuation force applied to the actuator; and an active dislodgement or return system comprising a dynamic member coupled to a lower base of the body, the dynamic member comprising a foot and a biasing member, the biasing member applying a force on the foot to urge the foot into an extended position, the dynamic member being rotatable, relative to the body, from a retracted position to the extended position to facilitate dislodging the body from a surrounding environment.

14. The trash can assembly of claim 13, wherein the dynamic member is configured to transition towards the extended position after release of the actuation force on the actuator to move the body relative to the surrounding environment.

15. The trash can assembly of claim 13, wherein the dynamic member comprises a spring.

16. A trash can assembly comprising:

a body comprising an upper sidewall and a lower base;

a lid coupled with the body, the lid configured to move between a closed position and an open position;

an actuation system comprising an actuator and a linkage, the actuation system configured to rotate the lid from the closed position to the open position in response to an actuation force applied to the actuator; and an active dislodgement or return system comprising a dynamic member coupled to a lower base of the body, the dynamic member being rotatable, relative to the body, from a retracted position to an extended position to facilitate dislodging the body from a surrounding environment, the dynamic member being configured to transition towards the extended position after release of the actuation force on the actuator.

17. The trash can assembly of claim 16, wherein the dynamic member comprises a foot and a biasing member, the biasing member applying a force on the foot to urge the foot into the extended position.

18. The trash can assembly of claim 17, wherein the foot is configured to engage a floor of the surrounding environment in the extended position.

19. The trash can assembly of claim 17, wherein the foot is configured to engage a floor of the surrounding environment in the retracted position.

20. A trash can assembly comprising:

a body comprising an upper sidewall and a lower base;

a lid coupled with the body, the lid configured to move between a closed position and an open position;

an actuation system comprising an actuator and a linkage, the actuation system configured to rotate the lid from the closed position to the open position in response to an actuation force applied to the actuator; and an active dislodgement or return system comprising a dynamic member coupled to a lower base of the body, the dynamic member being rotatable, relative to the body, from a retracted position to an extended position to facilitate dislodging the body from a surrounding environment, the dynamic member further being translatable, relative to the body.

* * * * *